US012310457B2

(12) United States Patent
Derr et al.

(10) Patent No.: US 12,310,457 B2
(45) Date of Patent: May 27, 2025

(54) UPPER FOR ARTICLE OF FOOTWEAR

(71) Applicant: NIKE, Inc., Beaverton, OR (US)

(72) Inventors: Kevin R. Derr, Portland, OR (US); Martin E. Evans, Portland, OR (US); Chin-Chen Huang, Taichung (TW); Cassidy R. Levy, West Linn, OR (US); Matthew D. Nordstrom, Portland, OR (US); Guillermo Raffaele, Portland, OR (US); Hyo Young Kim, Busan (KR)

(73) Assignee: NIKE, Inc.

( * ) Notice: Subject to any disclaimer, the term of this patent is extended or adjusted under 35 U.S.C. 154(b) by 105 days.

(21) Appl. No.: 17/496,725

(22) Filed: Oct. 7, 2021

(65) Prior Publication Data

US 2022/0110416 A1 Apr. 14, 2022

Related U.S. Application Data

(60) Provisional application No. 63/090,114, filed on Oct. 9, 2020.

(51) Int. Cl.

| | |
|---|---|
| ***A43C 11/14*** | (2006.01) |
| ***A43B 23/02*** | (2006.01) |
| ***A43C 11/00*** | (2006.01) |

(52) U.S. Cl.

CPC ..... *A43C 11/1493* (2013.01); *A43B 23/0245* (2013.01); *A43C 11/008* (2013.01)

(58) Field of Classification Search

CPC ..... A43B 23/0245; A43C 11/1493

See application file for complete search history.

(56) References Cited

U.S. PATENT DOCUMENTS

| | | | | |
|---|---|---|---|---|
| 1,540,903 A * | 6/1925 | Santoyo | A43B 23/024 36/3 A |
| 2,045,736 A * | 6/1936 | Turner | A43B 3/12 36/46.5 |
| 2,112,884 A * | 4/1938 | Gillette | A43B 3/126 36/43 |
| 2,161,472 A * | 6/1939 | Hurwit | A43B 1/02 36/3 R |

(Continued)

OTHER PUBLICATIONS

European Patent Office (ISA), International Search Report and Written Opinion for PCT App. No. PCT/US2021/054270, mailed Jan. 27, 2022.

*Primary Examiner* — Alissa L Hoey
*Assistant Examiner* — Akwokwo Olabisi Redhead
(74) *Attorney, Agent, or Firm* — Honigman LLP; Matthew H. Szalach; Jonathan P. O'Brien

(57) ABSTRACT

An upper for an article of footwear includes a fixed closure disposed on one of a medial side and a lateral side of the upper, a plurality of parallel first strands each extending from a first end attached to the other one of the medial side and the lateral side of the upper to a second end attached the other one of the medial side and the lateral side and including a first intermediate portion formed between the first end and the second end, and a plurality of parallel second strands each extending from a third end attached to the one of the medial side and the lateral side of the upper to a fourth end selectively attachable to the fixed closure. The second strands are looped around the first intermediate portion of respective ones of the first strands.

19 Claims, 26 Drawing Sheets

(56) References Cited

U.S. PATENT DOCUMENTS 4,081,916 A 4/1978 Salisbury
4,414,761 A 11/1983 Mahood
4,794,674 A 1/1989 Mintel et al.
4,794,706 A 1/1989 Puckhaber et al.
D300,781 S * 4/1989 Finn ..... D2/918
4,860,464 A 8/1989 Misevich et al.
5,027,482 A 7/1991 Torppey
5,791,068 A 8/1998 Bernier et al.
6,941,683 B2 9/2005 Freed
7,204,042 B2 * 4/2007 Aveni ..... A43B 23/0245 36/50.1
8,037,621 B2 * 10/2011 Hooper ..... A43B 23/0265 36/102
9,226,540 B2 * 1/2016 Podhajny ..... A43B 23/00
9,265,305 B2 2/2016 Hatfield et al.
9,402,437 B2 8/2016 Berns et al.
9,427,047 B2 * 8/2016 Dojan ..... A43B 23/0265
9,526,300 B2 12/2016 Krengel
9,707,119 B2 7/2017 Berns et al.
9,730,492 B2 8/2017 Krengel
D802,290 S 11/2017 Hatfield et al.
9,854,875 B2 1/2018 Hatfield et al.
9,907,359 B2 3/2018 Beers
D814,169 S 4/2018 Ngene
10,004,296 B2 6/2018 Zadnik
10,791,800 B2 * 10/2020 Fuerst, Jr. ..... A43B 23/027
11,674,244 B2 * 6/2023 Meir ..... A43B 23/04 66/170
2003/0051374 A1 3/2003 Freed
2005/0284002 A1 12/2005 Aveni
2006/0059715 A1 * 3/2006 Aveni ..... A43C 9/00 36/45
2006/0283042 A1 * 12/2006 Greene ..... A43B 23/042 36/50.1
2009/0071041 A1 * 3/2009 Hooper ..... A43B 23/0245 36/25 R
2010/0037486 A1 * 2/2010 Verheijen ..... A43C 11/1493 12/146 B
2010/0107442 A1 * 5/2010 Hope ..... A43C 1/00 36/50.1
2011/0302804 A1 * 12/2011 Hooper ..... A43B 23/0245 36/31
2011/0308108 A1 12/2011 Berns et al.
2013/0160328 A1 * 6/2013 Hatfield ..... A43B 7/20 36/103
2013/0255105 A1 * 10/2013 Bishop ..... A43B 7/28 36/25 R
2014/0005585 A1 * 1/2014 Berns ..... A61F 13/622 602/27
2014/0130372 A1 * 5/2014 Aveni ..... D04B 1/22 36/83
2014/0157629 A1 * 6/2014 Dojan ..... A43B 23/0245 36/83
2014/0223768 A1 * 8/2014 Berend ..... A43C 1/00 36/45
2014/0223771 A1 * 8/2014 Berend ..... A43B 23/0255 36/83
2015/0216257 A1 8/2015 Meir et al.
2016/0166009 A1 * 6/2016 Hatfield ..... A43B 23/02 36/103
2017/0273814 A1 * 9/2017 Berns ..... A43C 11/14
2017/0281391 A1 10/2017 Berns et al.
2017/0347754 A1 * 12/2017 Fuerst, Jr. ..... D04B 5/00
2018/0289100 A1 10/2018 Bell et al.
2018/0295942 A1 10/2018 Drake
2018/0343963 A1 * 12/2018 Bruce ..... A43B 23/045
2019/0313742 A1 10/2019 Bell et al.
2020/0008529 A1 * 1/2020 Luedecke ..... A43B 23/027
2020/0352282 A1 * 11/2020 Drake ..... A43C 11/004
2021/0037924 A1 * 2/2021 Bell ..... A43B 5/00
2021/0068502 A1 * 3/2021 Bell ..... A43B 1/0054
2021/0274887 A1 * 9/2021 Halligan ..... A43C 1/04
2022/0061455 A1 * 3/2022 Obier ..... A43B 7/20
2022/0110416 A1 * 4/2022 Derr ..... A43B 23/0245
2022/0264997 A1 * 8/2022 Hatano ..... A43B 23/22

* cited by examiner

UPPER FOR ARTICLE OF FOOTWEAR

This application claims priority under 35 U.S.C. § 119(e) to U.S. Provisional Application No. 63/090,114, filed on Oct. 9, 2020. The disclosure of this prior application is considered part of the disclosure of this application and is hereby incorporated by reference in its entirety.

FIELD

The present disclosure relates generally to articles of footwear, and more particularly, to uppers for articles of footwear.

BACKGROUND

This section provides background information related to the present disclosure which is not necessarily prior art.

Articles of footwear conventionally include an upper and a sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may be formed from any suitable material(s) to receive, secure and support a foot on the sole structure. In conventional articles of footwear, the upper is formed of one or more panels of the materials, which are stitched together to enclose an interior void. Here, different parts of the upper may be formed of different materials to provide desired characteristics. For instance, one or more of the panels may be formed of a breathable material to improve ventilation and comfort, while other panels are formed of more durable materials to provide strength and durability.

The upper may cooperate with laces, straps, or other fasteners to adjust the fit of the upper around the foot. Accordingly, provisions must be made within the panels forming the upper to accommodate routing of the fasteners along the upper. For example, the panels of the upper may be provided with one or more eyelets or guides for routing the laces along the upper. Additionally, to improve fit and maximize comfort the panels must be conformed to the contours of a foot, and are typically provided with one or more features for facilitating ventilation.

Thus, while suitable for their intended purpose, conventional uppers require increased complexity in joining each of the panels together and providing suitable fit and comfort. Moreover, the upper must be further modified to allow for incorporation of fasteners and/or adjustment means, thereby further increasing manufacturing complexity.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1A:
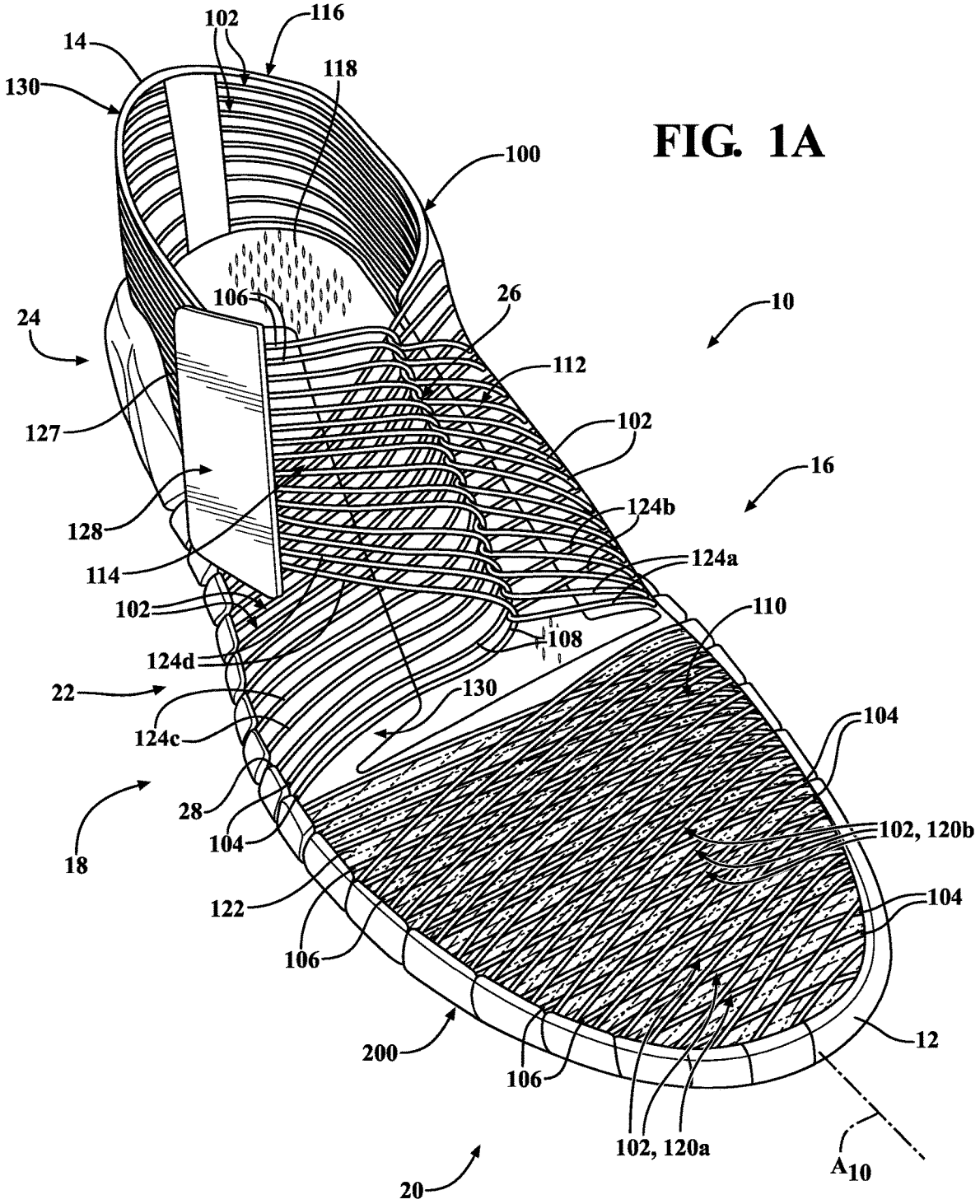
FIG. 1A is a perspective view of an article of footwear according to the principles of the present disclosure, where an upper of the article of footwear is shown in a closed configuration.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an upper for an article of footwear includes a fixed closure disposed on one of a medial side and a lateral side of the upper, a plurality of parallel first strands each extending from a first end attached to the other one of the medial side and the lateral side of the upper to a second end attached the other one of the medial side and the lateral side and including a first intermediate portion formed between the first end and the second end, and a plurality of parallel second strands each extending from a third end attached to the one of the medial side and the lateral side of the upper to a fourth end selectively attachable to the fixed closure. The second strands are looped around the first intermediate portion of respective ones of the first strands.

Implementations of the disclosure may include one or more of the following optional features. In one configuration, an adjustable closure is attached to the fourth ends of the plurality of parallel second strands and is selectively attachable to the fixed closure.

The first end of each of the first strands may be attached to a bite line of the upper at respective first locations, and the second end of each of the first strands may be attached to the bite line of the upper at respective second locations.

The intermediate portion of each of the first strands may include a loop. The loop of each of the first strands may be disposed along an instep region of the upper.

In one configuration, the plurality of parallel first strands may include at least five (5) strands.

The upper may include a toe cap having a plurality of third strands each extending from a fifth end attached to the medial side in a forefoot region of the upper to a sixth end attached to the lateral side in the forefoot region.

The fixed closure may be disposed adjacent to a bite line of the upper. Additionally or alternatively, the fixed closure may be disposed on the lateral side of the upper. Further, two or more of the first strands may be attached to each other.

In another configuration, an upper for an article of footwear includes (i) a first strap having a plurality of parallel first strands each extending from a first end attached to one of a medial side and a lateral side of the upper and each including a loop disposed adjacent to an instep region of the upper and (ii) a second strap having a plurality of parallel second strands each extending from a second end attached to the other one of the medial side and the lateral side of the upper to a third end selectively attachable to the other one of the medial side and the lateral side of the upper. Each of the second strands may pass through the loop of a respective one of the first strands.

Implementations of the disclosure may include one or more of the following optional features. In one configuration, the third end of each of the second strands may be attached to a closure that is selectively attachable to the upper.

The first end of each of the first strands may be attached to a bite line of the upper at respective first locations. The first locations may be located in a mid-foot region of the upper.

In one configuration, each of the first strands may include a first segment extending from a bite line of the upper to the loop, and a second segment extending from the bite line of the upper to the loop.

In one configuration, the plurality of first strands may include at least five (5) strands.

A plurality of third strands may each extend over a toe portion of the upper.

A closure may be disposed adjacent to a bite line of the upper. The third ends of the second strands may be selectively attachable to the closure. The closure may be disposed on the lateral side of the upper.

In one configuration, two or more of the first strands may be attached to each other.

An article of footwear may incorporate the upper described above.

Referring to the figures, the present disclosure includes various examples of articles of footwear 10-10*g* each including an upper 100-100*g* attached to a sole structure 200. As described in greater detail below with respect to each example, the upper 100-100*g* of each example includes a plurality of first strands 102 attached to a first side of the upper 100-100*g* that are wound or looped around respective second strands 102 attached to a second side of the upper 100-100*g* to provide an adjustable enclosure for securing a foot of a user to the sole structure 200.

For the sake of the disclosure, each of the articles of footwear 10-10*g* may be described with respect to the overall geometry of the articles of footwear 10-10*g*. For example, each of the articles of footwear 10-10*g* includes an anterior end 12 associated with a forward-most point of the footwear 10-10*g*, and a posterior end 14 corresponding to a rearward-most point of the footwear 10-10*g*. A longitudinal axis $A_F$ of the footwear 10-10*g* extends along a length of the footwear 10-10*g* from the anterior end 12 to the posterior end 14, and generally divides the footwear 10-10*g* into a medial side 16 and a lateral side 18. Accordingly, the medial side 16 and the lateral side 18 respectively correspond with opposite sides of the footwear 10-10*g* and extend from the anterior end 12 to the posterior end 14.

The articles of footwear 10-10*g* may be divided into one or more regions along the longitudinal axis $A_F$. The regions may include a forefoot region 20, a mid-foot region 22 and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone. A throat or instep region 26 extends between the medial side 16 and the lateral side 18 along the top of the articles of footwear 10-10*g* through the mid-foot region 22. The articles of footwear 10-10*g* may also include a bite line 28 formed around a base of the upper 100, where the upper 100-100*g* is attached to the sole structure 200.

As described in greater detail below, each example of the upper 100-100*g* includes a plurality of strands 102 arranged to define at least a portion of the upper 100-100*g*. Each of the strands 102 extends along the upper 100-100*g* from a first end 104 to a second end 106, where an intermediate portion 108 of each strand 102 extends between each end 104, 106 may define a portion of the upper 100-100*g*. To form various components of the upper 100-100*g*, the strands 102 are arranged in one or more groups of parallel strands 102, where each of the strands 102 within one of the groups is routed in parallel (e.g., does not overlap or intersect) with each other. In some examples, one or more groups of strands 102 may cooperate to define the components of the upper 100-100*g*.

Figure 1B:
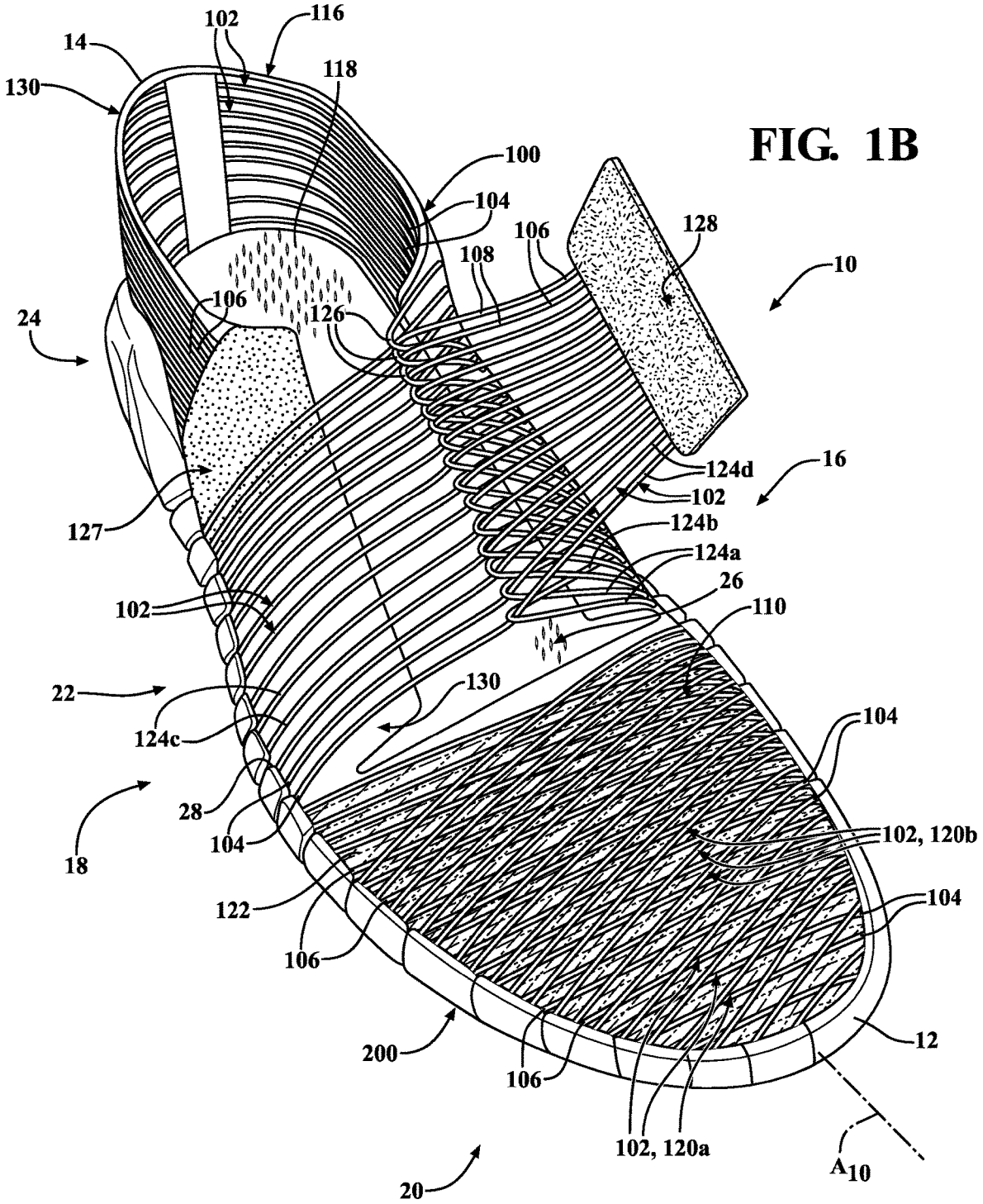
FIG. 1B is a perspective view of the article of footwear of FIG. 1A, where the upper of the article of footwear is shown in an open configuration.

Referring to FIGS. 1A and 1B, a first example of an article of footwear 10 according to the principles of the present disclosure is shown. In this example, the upper 100 includes a plurality of the strands 102 wound along the article of footwear 10 to form a toe cap 110 disposed in the forefoot region 20, a fixed strap 112 and an adjustment strap 114 disposed on opposite sides 16, 18 of the mid-foot region 22, and a cuff 116 extending around the heel region 24. Generally, the toe cap 110, the straps 112, 114, and the cuff 116 cooperate to define an interior void 118 within the upper 100. The interior void 118 is configured to receive a foot of a wearer therein. In this example, each of the toe cap 110, the straps 112, 114, and the cuff 116 may be formed by one or more groups of the strands 102, where the strands 102 of a group forming each one of the components 110, 112, 114, 116 are arranged in parallel.

Referring to FIG. 1A, the toe cap 110 includes a first group 120*a* of the strands 102 and a second group 120*b* of the strands 102, where each group 120*a*, 120*b* extends across the forefoot region 20 from the medial side 16 to the lateral side 18. As discussed above, the strands 102 of the first group 120*a* are all routed in parallel (i.e., not intersecting) to each other from the medial side 16 to the lateral side 18. Likewise, the strands 102 of the second group 120*b* are routed in parallel with each other from the medial side 16 to the lateral side 18. Here, the strands 102 of the first group 120*a* are arranged at an oblique angle relative to the strands 102 of the second group 120*b* to form a mesh-like structure over the forefoot region 20. For example, the strands 102 of the first group 120*a* may extend in a lateral direction across the forefoot region, substantially perpendicular to the longitudinal axis $A_{10}$, such that the first ends 104 and the second ends 106 of each of the strands 102 are the same distance from the anterior end 12, while the strands 102 of the second group 120*b* extend at an oblique angle from first ends 104 on the medial side 16 that are farther from the anterior end 12 than second ends 106 on the lateral side 18. Alternatively, both groups 120*a*, 120*b* of strands may extend at oblique angles relative to the longitudinal axis $A_{10}$.

In the illustrated example, the first group 120*a* of strands 102 and the second group 120*b* of strands 102 are arranged in a layered arrangement, such that the strands 102 of the second group 120*b* extend over the strands 102 of the first group 120*a*. In other examples, the strands 102 of the first group 120*a* and the second group 120*b* may be weaved, such that strands 102 of the first group 120*a* are alternatingly routed above and below subsequent strands 102 of the second group 120*b*, and vice versa.

In some examples, the strands 102 of the toe cap 110 may be tethered to each other to minimize spreading of the strands 102. For instance, strands 102 of the first group 120*a* may be tethered to strands 102 of the second group 120*b* at locations where the strands 102 overlap each other. Additionally or alternatively, the strands 102 within each group 120*a*, 120*b* may be tethered to adjacent strands 102 within the same group 120*a*, 120*b*. In the illustrated example, tethers 122 are formed as an elastomeric web 122 within which portions of the strands 102 of each layer 120*a*, 120*b* are embedded. In other examples, the tethers 122 may be adhesive points between the strands 102.

With continued reference to FIGS. 1A and 1B, the fixed strap 112 of the upper 100 includes a plurality of the strands 102 wound along the medial side 16 of the upper 100. As shown, each of the strands 102 of the fixed strap 112 extends along a first segment 124*a* from the first end 104 at the bite line 28 on the medial side 16 to the instep region 26, and then returns along a second segment 124*b* from the instep region 26 to the second end 106 at the bite line 28 on the medial side 16. Thus, each of the strands 102 of the fixed strap 112 is folded or turned back on itself in the instep region 26 to form a loop 126 in the instep region 26. As shown, the plurality of strands 102 of the fixed strap 112 cooperate to provide a plurality of the loops 126 arranged in series along the instep region 26. While the loops 126 of the fixed strap 112 are inherently formed by folding the strands 102 upon themselves, in other examples the loops 126 may be independently formed of a different material than the strands 102 and attached to the strands 102 in the instep region 26. For instance, flexible or rigid grommets may be attached between the first and second segments 124*a*, 124*b* of each strand.

In the illustrated example, each of the strands 102 of the fixed strap 112 includes the first end 104 attached at a first respective location along the bite line 28 in the mid-foot region 22, and the second end 106 attached along a second respective location along the bite line 28 in the mid-foot region 22. Here, the first end 104 is closer to the anterior end 12 than the second end 106 so that the first segment 124*a* and second segment 124*b* of each strand 102 extend at oblique angles relative to each other along the medial side 16 of the upper 100. In other words, the first segment of each strand 102 may extend at a first angle from the bite line 28 to the loop 126 in the instep region 26, while the second segment of the respective strand 102 extends at a second angle—transverse to the first angle—from the bite line 28 to the loop 126 in the instep region 26. This configuration provides longitudinal stability to the loops 126 along the instep region 26, whereby when each of the strands 102 of the fixed strap 112 are placed in tension, the longitudinal movement of each loop 126 is limited by the forward and rearward extending segments 124*a*, 124*b* of each strand 102.

With continued reference to FIGS. 1A and 1B, the adjustment strap 114 of the upper 100 is configured in a similar fashion as the fixed strap 112, and includes a plurality of the strands 102 extending along the lateral side 18 of the upper 100. As shown, each of the strands 102 of the adjustment strap 114 extends along a first segment 124*c* from the first end 104 at the bite line 28 on the lateral side 16 to the instep region 26. Here, the intermediate portion 108 of each of the strands 102 of the adjustment strap 114 is routed through a respective one of the loops 126 formed by the fixed strap 112, and then returns along a second segment 124*d* to a free-hanging second end 106. Thus, unlike the fixed strap 112, where both ends 104, 106 of each strand 102 are fixed, the second ends 106 of the adjustment strap 114 are moveable relative to the upper 100.

As shown, the upper 100 includes closures 127, 128 for selectively securing the second ends 106 of the adjustment strap 114 to the upper 100. A fixed closure 127 is provided as a fixed element along the lateral side 18 of the upper 100 in the mid-foot region 22, while an adjustable closure 128 is attached to the free-hanging second ends 106 of the adjustment strap 114. The adjustable closure 128 may be formed as a unitary member, such that the second end 106 of each strand 102 of the adjustment strap 114 is connected to the adjustable closure 128 for collective attachment to and detachment from the fixed closure 127. Thus, the free end of the adjustment strap 114 can be selectively secured to the upper 100 and, more particularly, to the fixed closure 127 using the adjustable closure 128. In one example, the fixed closure 127 and the adjustable closure 128 are embodied as cooperating hook-and-loop elements. However, in other examples, the closures 127, 128 may be include magnetic elements, snaps, buttons, or other types of closures.

In the illustrated example, each of the strands 102 of the adjustment strap 114 includes the first end 104 attached at a first respective location along the bite line 28 in the mid-foot region 22, while the fixed closure 127 is disposed adjacent to the bite line 28 at a position rearward of the first ends 104. Thus, when the adjustable closure 128 is attached to the fixed closure 127, the second ends 106 of each strand 102 will be offset rearwardly from the respective first ends 104, such that the first segment 124*c* and second segment 124*d* of each strand 102 extend at oblique angles relative to each other along the lateral side 18 of the upper 100. In other words, the first segment 124*c* of each strand 102 may extend at a first angle from the bite line 28 to the loop 126 in the instep region 26, while the second segment 124*d* of the respective strand 102 extends at a second angle transverse to the first angle from the fixed closure 127 to a respective one of the loops 126 in the instep region 26. As with the fixed strap 112, this configuration provides longitudinal stability to the adjustment strap 114 along the lateral side 18 of the upper 100, whereby when each of the strands 102 of the adjustment strap 114 is placed in tension, the longitudinal movement of each strand 102 is limited by the forward and rearward extending segments 124*c*, 124*d* of the strand 102.

With continued reference to FIGS. 1A and 1B, the upper 100 may further include a collar or cuff 116 extending around the heel region 24 to enclose a rear portion of the interior void 118 of the upper 100. As best shown in FIG. 1B, the cuff 116 includes a plurality of the strands 102 each extending in parallel from a first end 104 on the medial side 16 of the upper 100, around the posterior end 14, and to a second end 106 on the lateral side 18 of the upper 100. In some examples, the ends 104, 106 of each strand 102 may be attached at the bite line 28 of the article of footwear 10. Additionally or alternatively, one or more of the ends 104, 106 may be tethered to one of the strands 102 of the straps 112, 114.

As with the toe cap 110, the strands 102 of the straps 112, 114 and the cuff 116 may be tethered to each other to minimize relative movement. For example, the upper 100 may include an elastomeric web 130 extending along each of the medial side 16 and the lateral side 18 in the mid-foot region 22, and around the heel region 24. As shown, the web 130 may encapsulate at least lower portions of the first segments 124*a*, 124*c* (i.e., adjacent to the bite line 28 between the first ends 104 and the loops 126 of the straps 112, 114). The elastomeric web 130 also encapsulates the strands 102 forming the cuff 116.

Figure 2A:
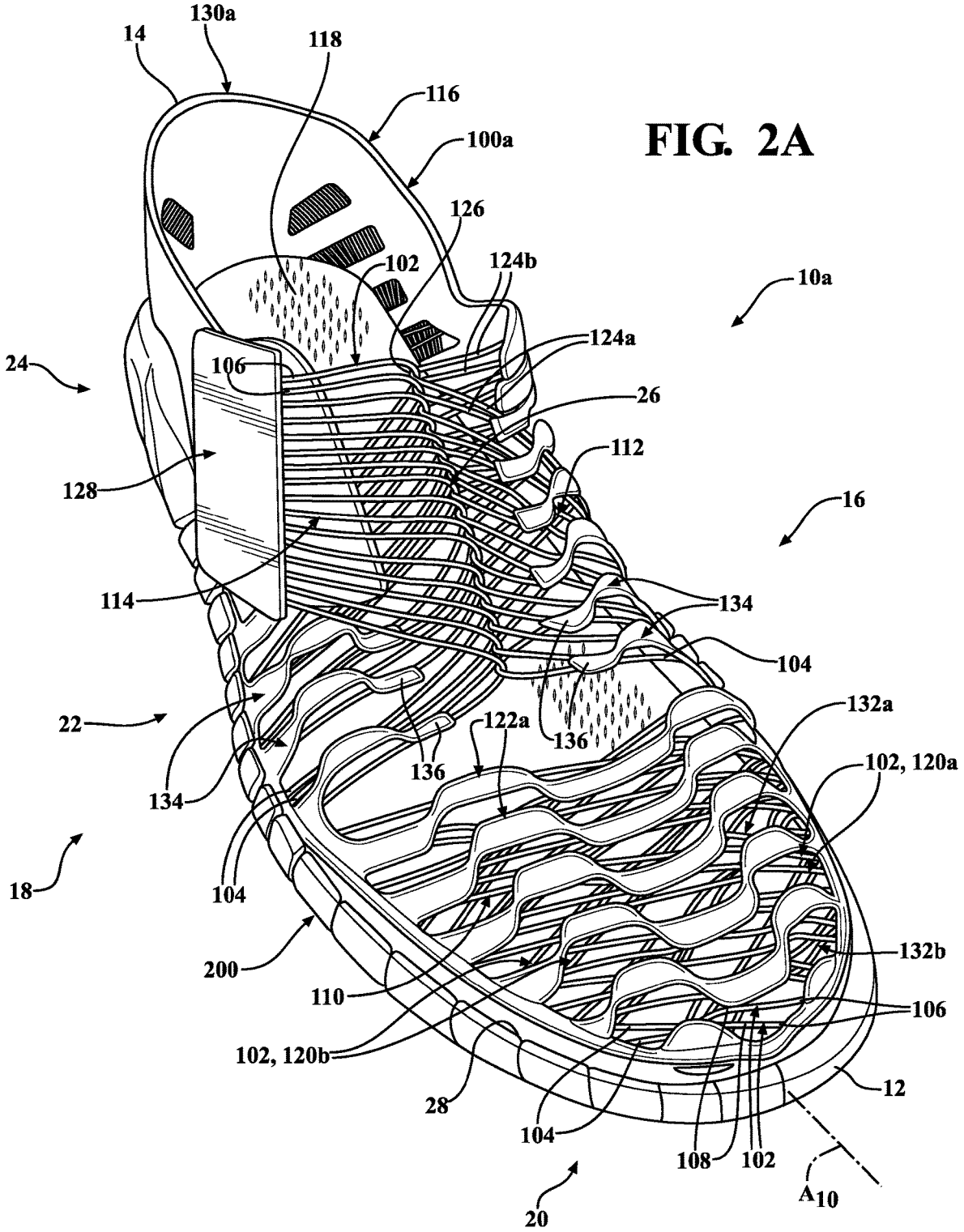
FIG. 2A is a perspective view of an article of footwear according to the principles of the present disclosure, where an upper of the article of footwear is shown in a closed configuration.
Figure 2B:
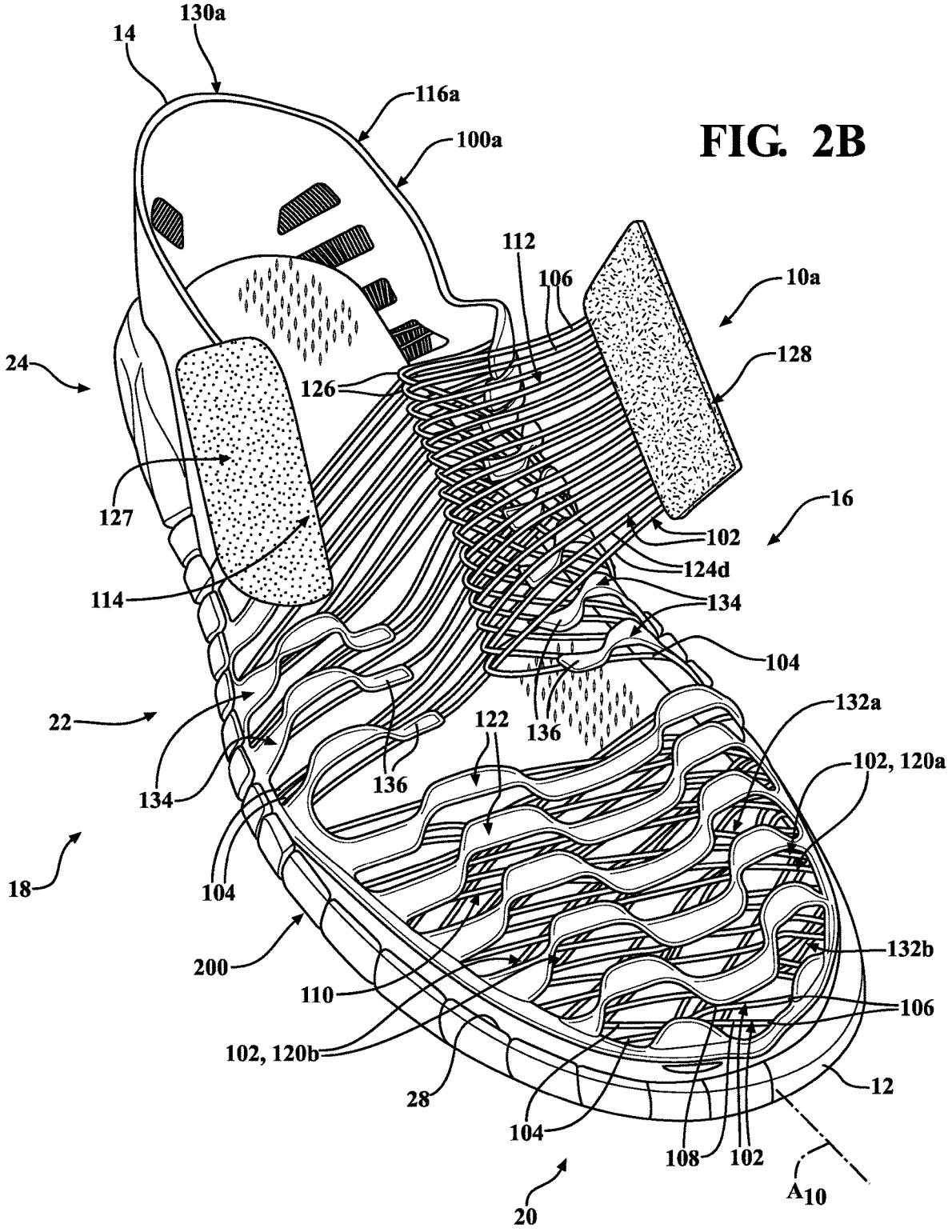
FIG. 2B is a perspective view of the article of footwear of FIG. 2A, where the upper of the article of footwear is shown in an open configuration.

With particular reference to FIGS. 2A and 2B, an article of footwear 10*a* is provided and includes an upper 100*a* and the sole structure 200 attached to the upper 100*a*. In view of the substantial similarity in structure and function of the components associated with the article of footwear 10 with respect to the article of footwear 10*a*, like reference numerals are used hereinafter and in the drawings to identify like components, while like reference numerals containing letter extensions are used to identify those components that have been modified.

In the example of FIGS. 2A and 2B, the elastomeric tethers 122 and web area 130 discussed above with respect to the upper 100 have been replaced with embroidered tethers 122*a* and an embroidered web area 130*a*. As shown, each of the tethers 122*a* extends continuously across the toe cap 110 from the medial side 16 to the lateral side 18 along an undulated path. Each tether 122*a* may be embroidered through adjacent ones of the strands 102 of the first group 120*a* and the second group 120*b* to form clusters 132*a*, 132*b* of the strands 102 in each group 120*a*, 120*b*. In some areas, the tethers 122*a* may be embroidered through the both groups 120*a*, 120*b* so that the clusters 132*a* of the first group 120*a* are tethered to the clusters 132*b* of the second group 120*b*.

With continued reference to FIGS. 2A and 2B, the web area 130*a* of the upper 100*a* is also formed as an embroidered structure. Along each of the medial side 16 and the lateral side 18, the web area 130*a* includes a plurality of undulated fingers 134 extending from the bite line 28 to respective terminal ends 136 adjacent to the instep region 26. As shown, each of the fingers 134 extends along the first segments 124*a*, 124*c* of two or more of the strands 102, whereby adjacent ones of the first segments 124*a*, 124*c* are clustered along a length of each finger 134. The web area 130*a* may further extend around the cuff 116*a* to tether the strands 102 of the cuff 116*a* to each other, thereby forming a substantially enclosed cuff 116*a* around the posterior end 14 of the upper 100.

Figure 3A:
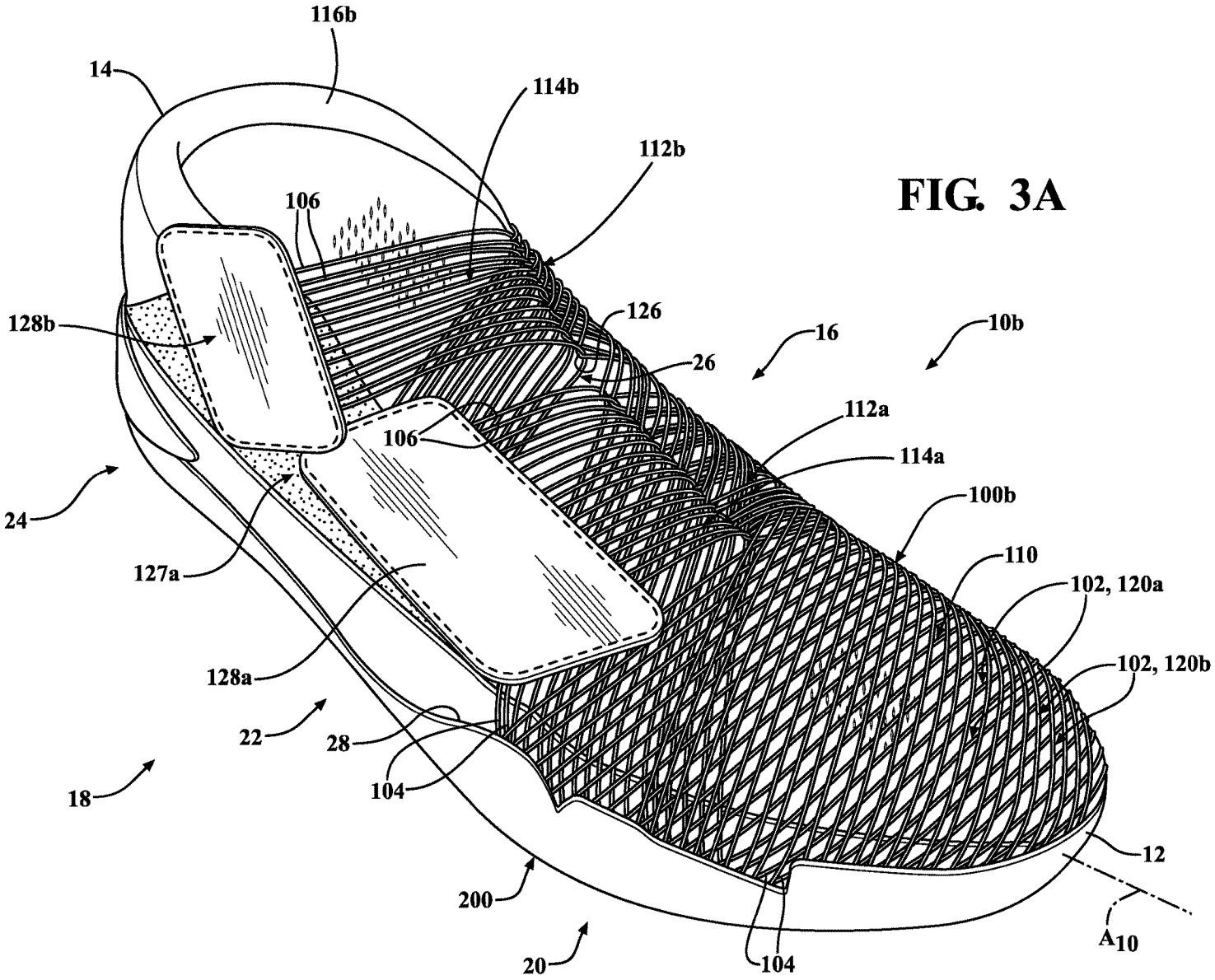
FIG. 3A is a perspective view of another article of footwear according to the principles of the present disclosure, where an upper of the article of footwear is shown in a closed configuration.
Figure 3B:
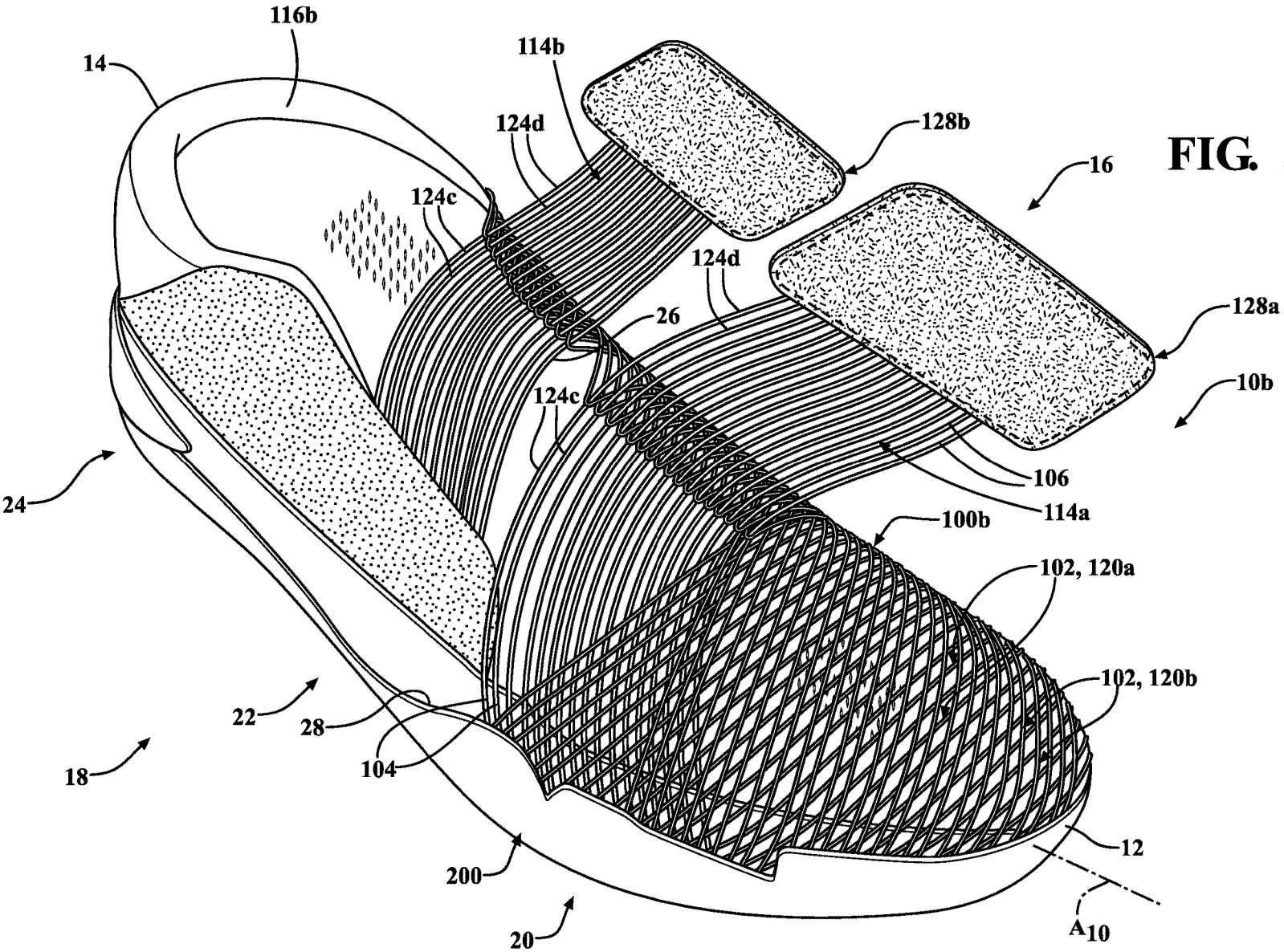
FIG. 3B is a perspective view of the article of footwear of FIG. 3A, where the upper of the article of footwear is shown in an open configuration.

With particular reference to FIGS. 3A and 3B, an article of footwear 10*b* is provided and includes an upper 100*b* and the sole structure 200 attached to the upper 100*b*. In view of the substantial similarity in structure and function of the components associated with the article of footwear 10 with respect to the article of footwear 10*b*, like reference numerals are used hereinafter and in the drawings to identify like components, while like reference numerals containing letter extensions are used to identify those components that have been modified.

In the example of the article of footwear 10*b* shown in FIGS. 3A and 3B, the upper 100*b* includes anterior straps 112*a*, 114*a* and posterior straps 112*b*, 114*b* extending over the instep region 26, thereby providing the upper 100*b* with zonal tightening along the instep region 26. Here, the upper 100*b* includes an anterior fixed strap 112*a* having a plurality of the strands 102 extending in parallel from respective first ends 104 at the bite line 28, to the instep region 26, and back to respective second ends 106 at the bite line 28, similar to the strands 102 of the fixed strap 112 discussed above. As such, the anterior fixed strap 112*a* forms a first plurality of the loops 126 along a lower portion of the instep region 26. Likewise, the upper 100*b* includes a posterior fixed strap 112*b* having a plurality of the strands 102 extending from the bite line 28 to the instep region 26, and back to the bite line 28 at a second location along the medial side 16. In the illustrated example, the first ends 104 of the strands 102 forming the anterior fixed strap 112*a* are positioned closer to the anterior end 12 than the first ends 104 of the strands 102 forming the posterior fixed strap 112*b*. Similarly, the second ends 106 of the strands 102 forming the anterior fixed strap 112*a* are positioned closer to the anterior end 12 than the second ends 106 of the strands 102 forming the posterior fixed strap 112*a*. As a result, the loops 126 of the posterior fixed strap 112*b* are positioned rearward of the loops 126 of the anterior fixed strap 112*a*. In some instances, the second segments 124*b* of the anterior fixed strap 112*a* may overlap the first segments 124*b* of the posterior fixed strap 112*b*, such that second ends 106 of the strands 102 forming the anterior fixed strap 112*a* are positioned rearward of the first ends 104 of the strands 102 forming the posterior fixed strap 112*b*.

On the lateral side 18 of the upper 100*b*, the strands 102 of the anterior adjustment strap 114*a* extend from first ends 104 attached at the bite line 28 in the forefoot region 20 of the footwear 10*b*, and are routed through the loops 126 of the anterior fixed strap 112*a*. Likewise, the strands 102 of the posterior adjustment strap 114*b* extend from first ends 104 attached at the bite line 28 in the mid-foot region 22 of the footwear 10*b*, and are routed through the loops 126 of the posterior fixed strap 112*b*. Each of the anterior adjustment strap 114*a* and the posterior adjustment strap 114*b* include a respective adjustable closure 128*a*, 128*b* attached to the second ends 106 of the strap 114*a*, 114*b*. As shown, the upper 100*b* further includes a fixed closure 127*a* extending along the bite line 28 on the lateral side 18 of the upper 100. While the fixed closure 127*a* is provided as a unitary and continuous fixed closure 127*a* along the lateral side 18, the fixed closure 127*a* may include fragments corresponding to the individual adjustable closures 128*a*, 128*b* of the anterior and posterior adjustment straps 114*a*, 114*b*.

As illustrated, the upper 100*b* may include one or more portions formed of panel or sheet materials, as opposed to the strands 102. For instance, the cuff 116*b* of the upper 100*b* may be formed of one or more panels of fabric, foam, synthetic, or leather materials, similar to conventional uppers. Here, portions of the strands 102, such as the ends 104, 106, may be integrated with or attached to the panels.

Figure 4A:
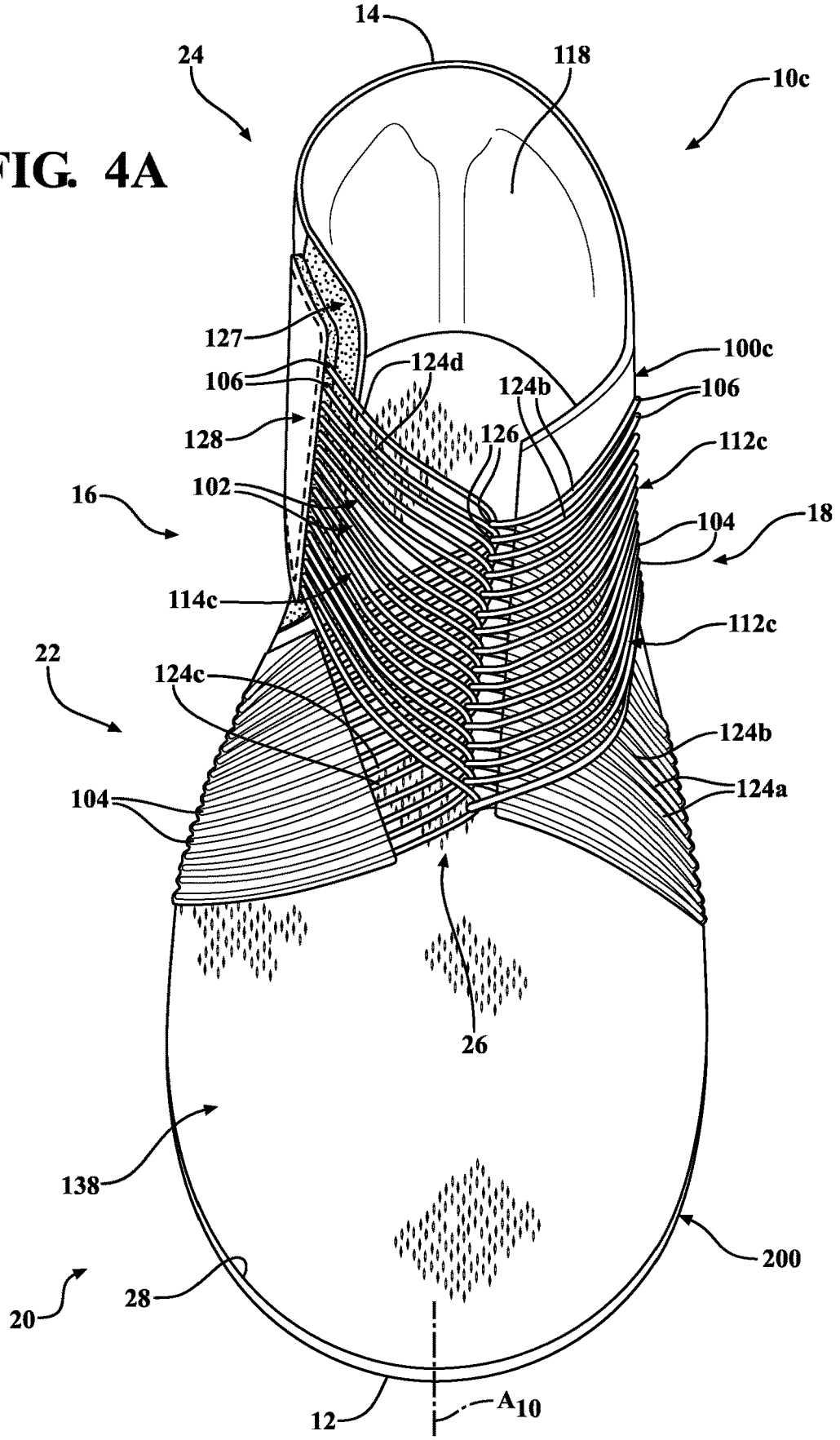
FIG. 4A is a perspective view of an article of footwear according to the principles of the present disclosure, where an upper of the article of footwear is shown in a closed configuration.
Figure 4B:
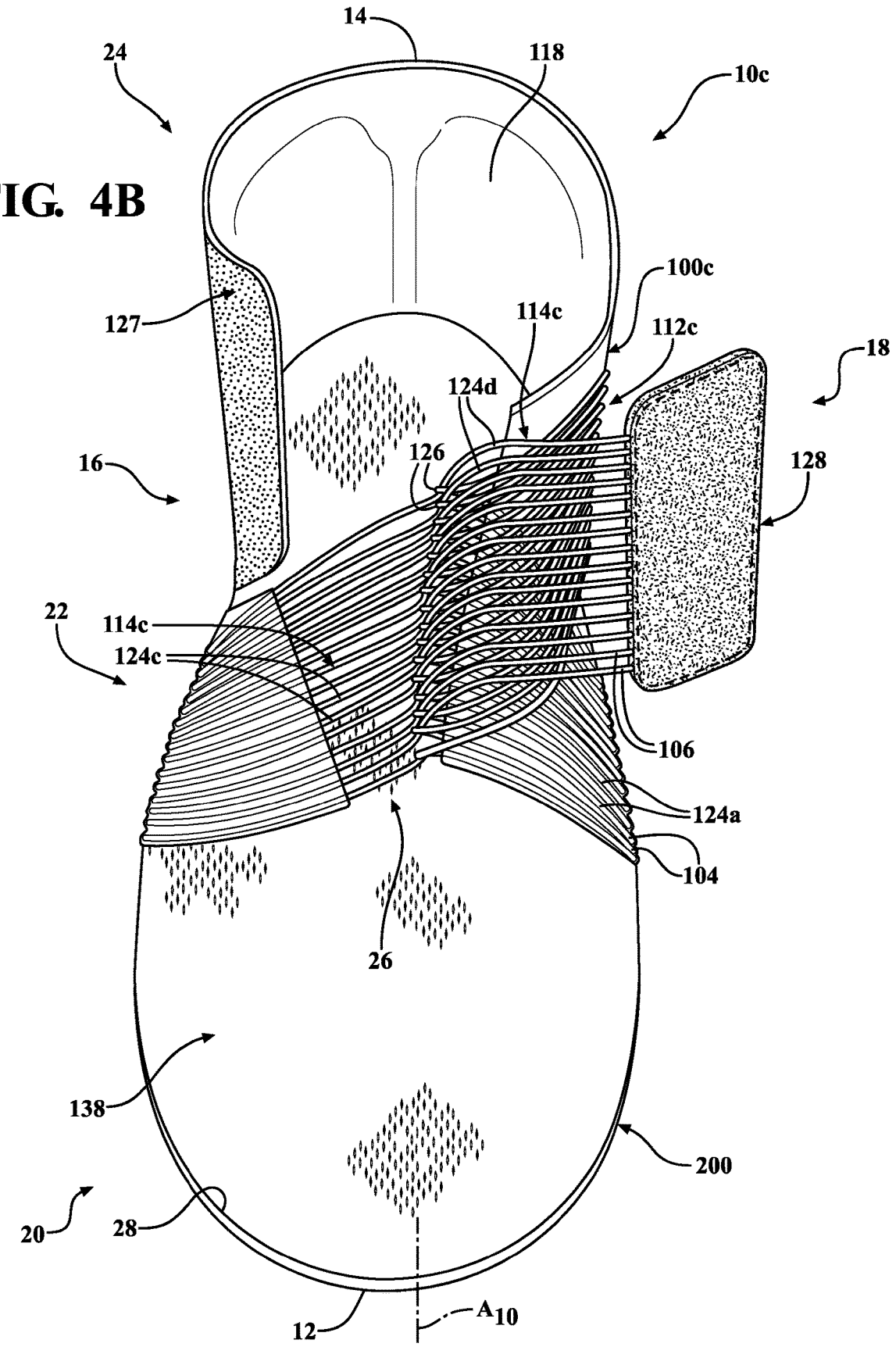
FIG. 4B is a perspective view of the article of footwear of FIG. 4A, where the upper of the article of footwear is shown in an open configuration.

With particular reference to FIGS. 4A and 4B, an article of footwear 10*c* is provided and includes an upper 100*c* and the sole structure 200 attached to the upper 100*c*. In view of the substantial similarity in structure and function of the components associated with the article of footwear 10 with respect to the article of footwear 10*c*, like reference numerals are used hereinafter and in the drawings to identify like components, while like reference numerals containing letter extensions are used to identify those components that have been modified.

In the example shown in FIGS. 4A and 4B, the upper 100*c* is provided with an inner sock or enclosure 138. As shown, the enclosure 138 includes a knitted fabric layer enclosing the interior void 118 of the upper 100*c*. Here, the enclosure 138 serves as the primary enclosure of the upper 100*c*, while the upper 100*c* further includes a fixed strap 112*c* and an adjustment strap 114*c* for adjusting a fit of the enclosure 138 around the foot. Thus, unlike the previous examples, where the forefoot region 20 is enclosed by the strands of the toe cap 110 and the heel region 24 is enclosed by the strands 102 of the cuff 116, in the present example, the material of the enclosure 138 encloses the forefoot region 20 and the heel region 24.

Figure 5A:
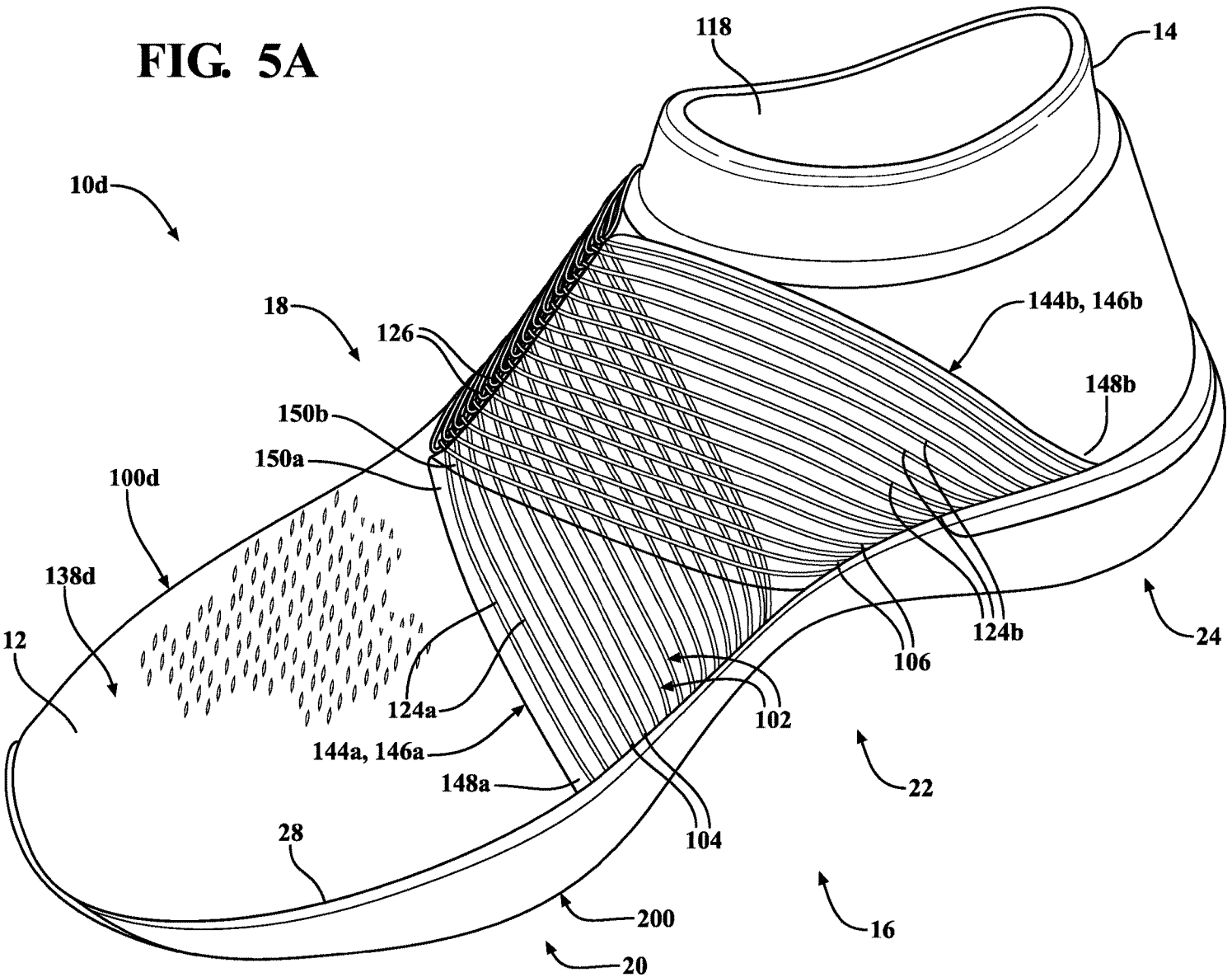
FIG. 5A is a lateral side perspective view of an article of footwear according to the principles of the present disclosure, where an upper of the article of footwear includes an enclosure.
Figure 5B:
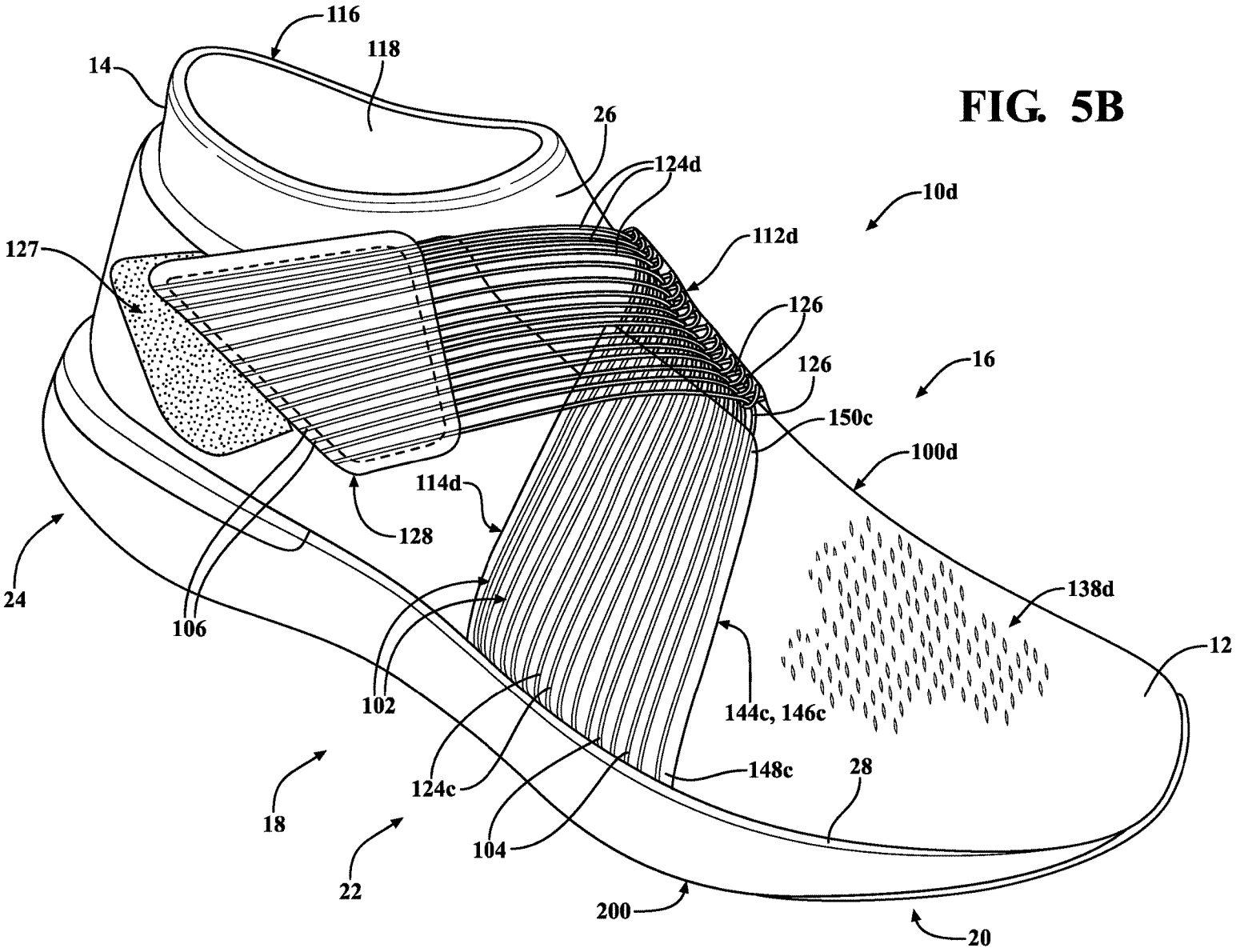
FIG. 5B is a lateral side perspective view of the article of footwear of FIG. 5A.

With particular reference to FIGS. 5A and 5B, an article of footwear 10*d* is provided and includes an upper 100*d* and the sole structure 200 attached to the upper 100*d*. In view of the substantial similarity in structure and function of the components associated with the article of footwear 10 with respect to the article of footwear 10*d*, like reference numerals are used hereinafter and in the drawings to identify like components, while like reference numerals containing letter extensions are used to identify those components that have been modified.

In the example shown in FIGS. 5A and 5B, the upper 100*d* is provided with an inner sock or enclosure 138*d*. As shown, the enclosure 138*d* includes a knitted fabric layer enclosing the interior void 118 of the upper 100*d*. Here, the enclosure 138*d* serves as the primary enclosure of the upper 100*d*, while the upper 100*d* further includes a fixed strap 112*d* and an adjustment strap 114*d* for adjusting a fit of the enclosure 138*d* around the foot.

In the illustrated example, the fixed strap 112*d* and the adjustment strap 114*d* are formed substantially similar to the straps 112, 114 discussed above with respect to FIGS. 1A and 1B. Thus, the fixed strap 112*d* of the upper 100*d* includes a plurality of the strands 102 wound along the medial side 16 of the upper 100*d* and the adjustment strap 114*d* includes a plurality of the strands 102 wound along the lateral side 18 of the upper 100*d*. Similar to the straps 112, 114 of FIGS. 1A and 1B, the strands 102 of the straps 112*d*, 114*d* of FIGS. 5A and 5B include the respective segments 124*a*-124*d* extending from the ends 104, 106 of the strands 102 to the loops 126 of the strands 102. However, in the present example, adjacent ones of the first segments 124*a* and adjacent ones of the second segments 124*b* of the fixed strap 112*d* are connected to each other by respective first and second elastomeric webs 144*a*, 144*b*. Similarly, adjacent ones of the third segments 124*c* of the adjustment strap 114*d* are connected to each other by a third elastomeric web 144*c*.

The webs 144*a*-144*c* cooperate with the segments 124*a*-124*c* of the straps 112*d*, 114*d* to form unitary bands 146*a*-146*c* extending along portions of the straps 112*d*, 114*d*. Particularly, the first web 144*a* extends along the first segments 124*a* from a first end 148*a* at the bite line 28 on the medial side 16 to a second end 150*a* adjacent to the loops 126 of the fixed strap 112*d*. Likewise, the second web 144*b* extends along the second segments 124*b* from a first end 148*b* at the bite line 28 on the medial side 16 to a second end 150*b* adjacent to the loops 126 of the fixed strap 112*d*. Thus, as shown, the individual loops 126 formed by the strands 102 of the fixed strap 112*d* are disconnected from each other between the first web 144*a* and the second web 144*b*.

Referring to FIG. 5B, on the adjustment strap 114*d* the third web 144*c* extends along the first segments 124*c* from a first end 148*c* at the bite line 28 on the lateral side 18 to a second end 150*c* adjacent to the loops 126 of the adjustment strap. In contrast to the fixed strap 112*d*, which includes webs 144*a*, 144*b* extending along the first segments 124*a* and the second segments 124*b*, the adjustment strap 114*d* only includes the third web 144*c* extending along the first segments 124*c*. Thus, the second segments 124*d* of the adjustment strap 114*d* are independent of each other such that the second segments 124*d* can pass through respective ones of the loops 126 of the fixed strap 112*d* to move the upper 100*d* between a tightened state and a loosened state.

As shown, the upper 100*d* includes the fixed and adjustable closures 127, 128 for selectively securing the second ends 106 of the adjustment strap 114*d* to the upper 100*d*. The fixed closure 127 is provided as a fixed element along the lateral side 18 of the upper 100*d* in the mid-foot region 22, while the adjustable closure 128 is attached to the free-hanging second ends 106 of the adjustment strap 114*d*. The adjustable closure 128 may be formed as a unitary member, such that the second end 106 of each strand 102 of the adjustment strap 114*d* is connected to the adjustable closure 128 for collective attachment to and detachment from the fixed closure 127. Thus, the free end of the adjustment strap 114*d* can be selectively secured to the upper 100*d* and, more particularly, to the fixed closure 127 using the adjustable closure 128.

Figure 6A:
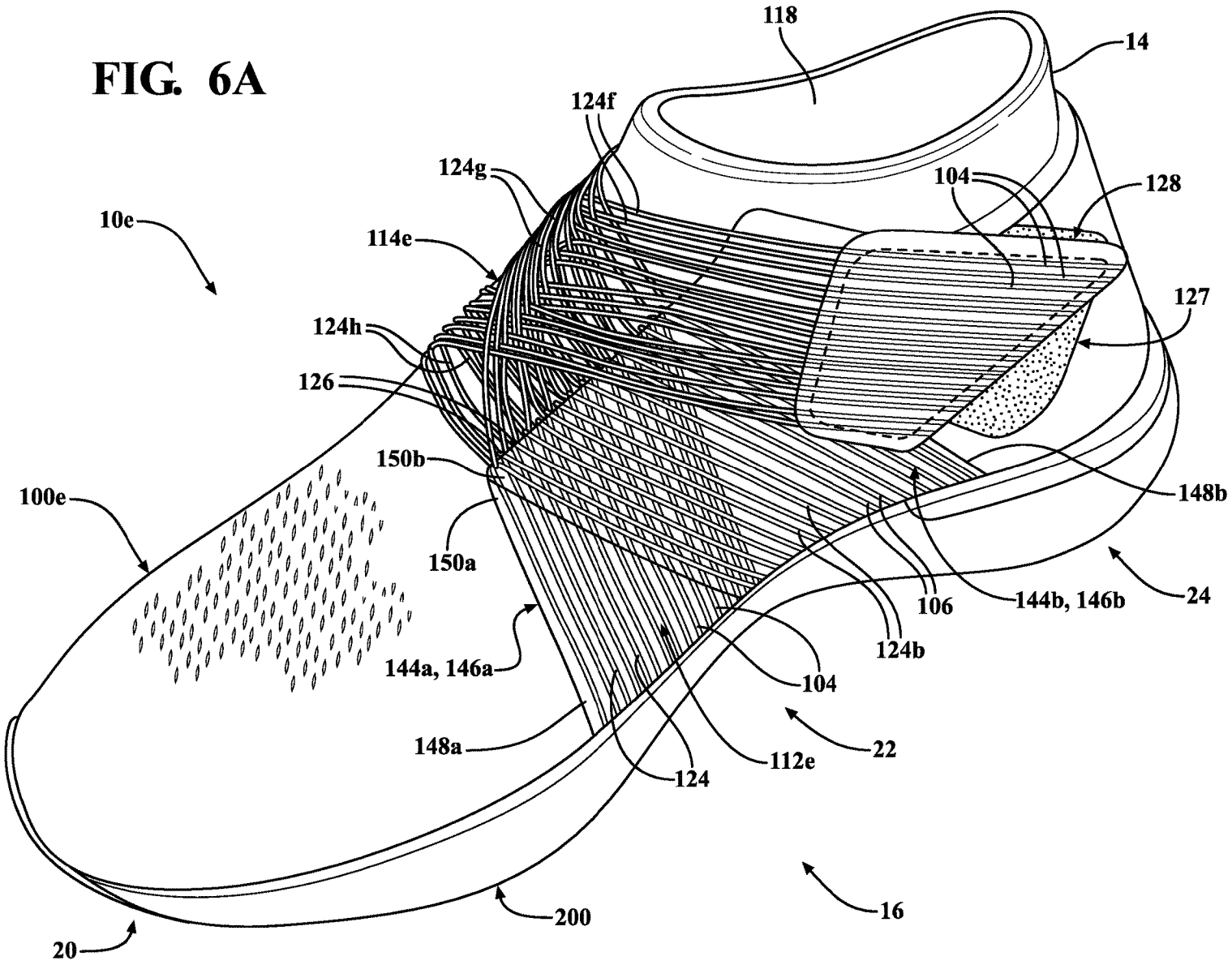
FIG. 6A is a lateral side perspective view of an article of footwear according to the principles of the present disclosure, where an upper of the article of footwear includes an enclosure.
Figure 6B:
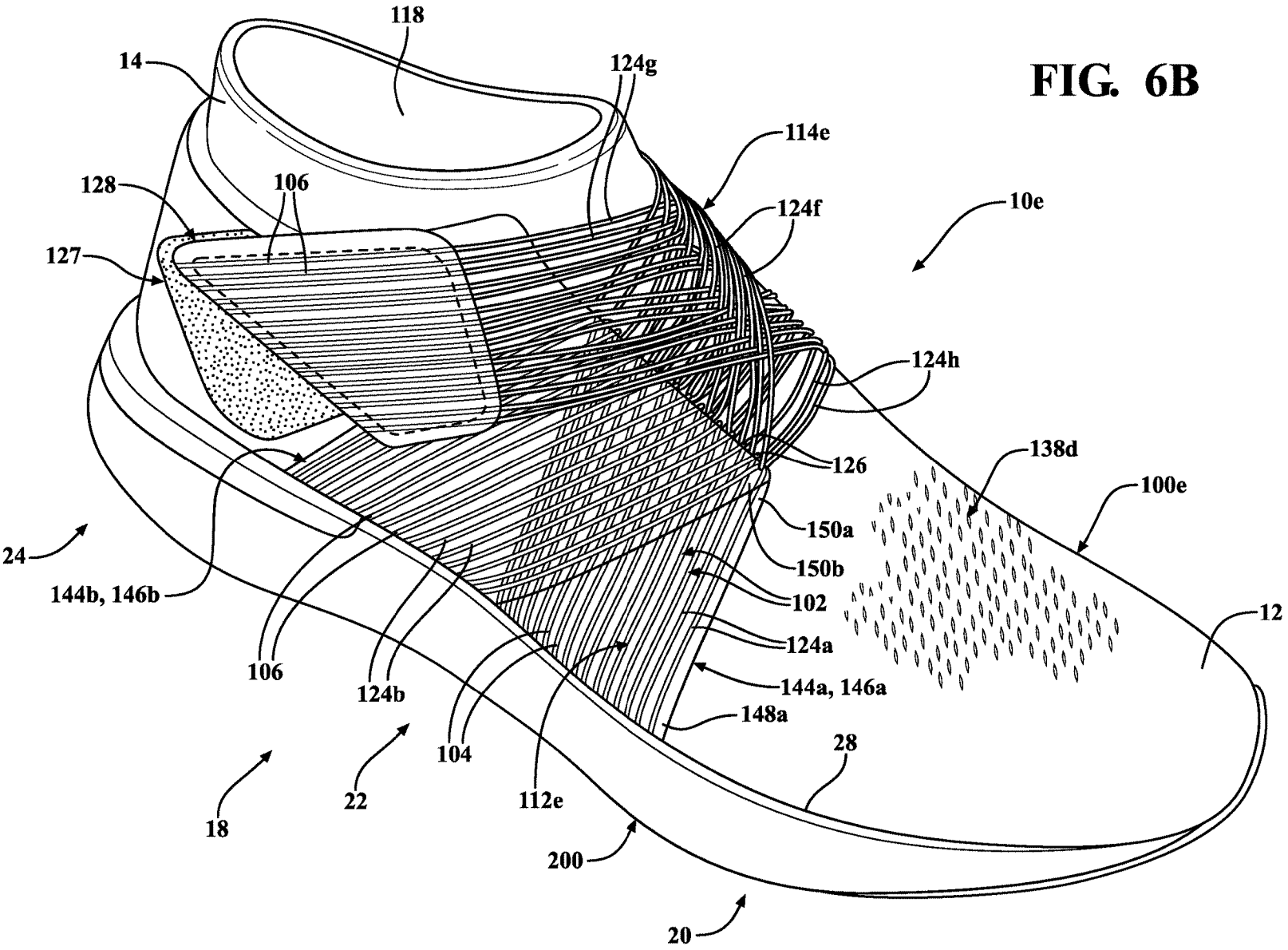
FIG. 6B is a lateral side perspective view of the article of footwear of FIG. 6A.

With particular reference to FIGS. 6A and 6B, an article of footwear 10*e* is provided and includes an upper 100*e* and the sole structure 200 attached to the upper 100*e*. In view of the substantial similarity in structure and function of the components associated with the article of footwear 10 with respect to the article of footwear 10*e*, like reference numerals are used hereinafter and in the drawings to identify like components, while like reference numerals containing letter extensions are used to identify those components that have been modified.

As shown in FIGS. 6A and 6B, the upper 100*e* includes a pair of fixed straps 112*e* disposed on opposite sides 16, 18 of the upper 100*e* and each having a substantially similar configuration to the fixed strap 112*d* discussed previously. That is, each of the fixed straps 112*e* includes a plurality of the strands 102 extending from a first end 104 attached to the bite line 28 at a first location to a second end 106 attached to the bite line 28 at a second location. The strands 102 of the fixed straps 112*e* are folded over on each other to form the first and second segments 124*a*, 124*b* and the plurality of the loops 126. As discussed above, the adjacent first segments 124*a* of each of the fixed straps 112*e* are attached to each other by respective ones of the first webs 144*a* extending along the first segments 124*a* from the first end 148*a* at the bite line 28 to the second end 150*a* adjacent to the loops 126. Likewise, the adjacent second segments 124*b* of each of the fixed straps 112*e* are attached to each other by respective ones of the second webs 144*b* extending along the second segments 124*b* from the first end 148*b* at the bite line 28 to the second end 150*b* adjacent to the loops 126. Accordingly, the loops 126 of the straps 112*e* are disconnected from each other and are arranged along opposite sides of the instep region 26.

The adjustment strap 114*e* of the upper 100*e* includes a plurality of the strands 102 each extending from a first end 104 attached to a first adjustable closure 128 to a second end attached to a second adjustable closure 128. As shown, each of the strands 102 includes a first end segment 124*f* extending from the first end 104 (i.e., attached to one of the adjustable closures 128), a second end segment 124*g* extending from the second end 106 (i.e., attached to the other one of the adjustable closures 128), and an intermediate segment 124*h* connecting the first end segment 124*f* and the second end segment 124*g* and extending between corresponding loops 126 of the fixed straps 112*e*. For instance, as shown in FIGS. 6A and 6B, each one of the strands 102 extends from the first end 104 attached to the first adjustment element 128 on the medial side 16 (FIG. 6B) and across the instep region 26 to one of the loops 126 of the fixed strap 112*e* on the lateral side 18 (FIG. 6A), forming the first end segment 124*f*. Each strand 102 then extends back across the instep region 26 from the loop 126 on the lateral side fixed strap 112*e* to a corresponding loop 126 of the fixed strap 112*e* on the medial side 16 to form the intermediate segment 124*h*. From the medial side fixed strap 112*e*, the strand 102 extends across the instep region 26 to the second end 106 attached to the second adjustable closure 128 on the lateral side 18.

In use, the first end segments 124*f* and the second end segments 124*g* overlap each other when the adjustment strap 114*e* is in a fastened configuration, as shown in FIGS. 6A and 6B. Here, the adjustable closure 128 attached to the first end segments 124*f* is selectively attached to a fixed closure 127 on the medial side 16 in the heel region 24 and the adjustable closure 128 attached to the second end segments 124*g* is selectively attached to a fixed closure 127 on the lateral side 18 in the heel region 24. To loosen the upper 100*e*, one or both of the adjustable closures 128 can be detached from the fixed closure 127 so that the strands 102 can be pulled through the loops 126 of the fixed straps 112*e* to increase effective lengths of the intermediate segments 124*h* (i.e., a distance between the loops 126) across the instep region 26. Conversely, the upper 100*e* can be tightened by pulling one or both of the adjustable fasteners 128 towards the bite line 28 and/or the posterior end 14 to decrease the effective lengths of the intermediate segments 124*h*.

Figure 7A:
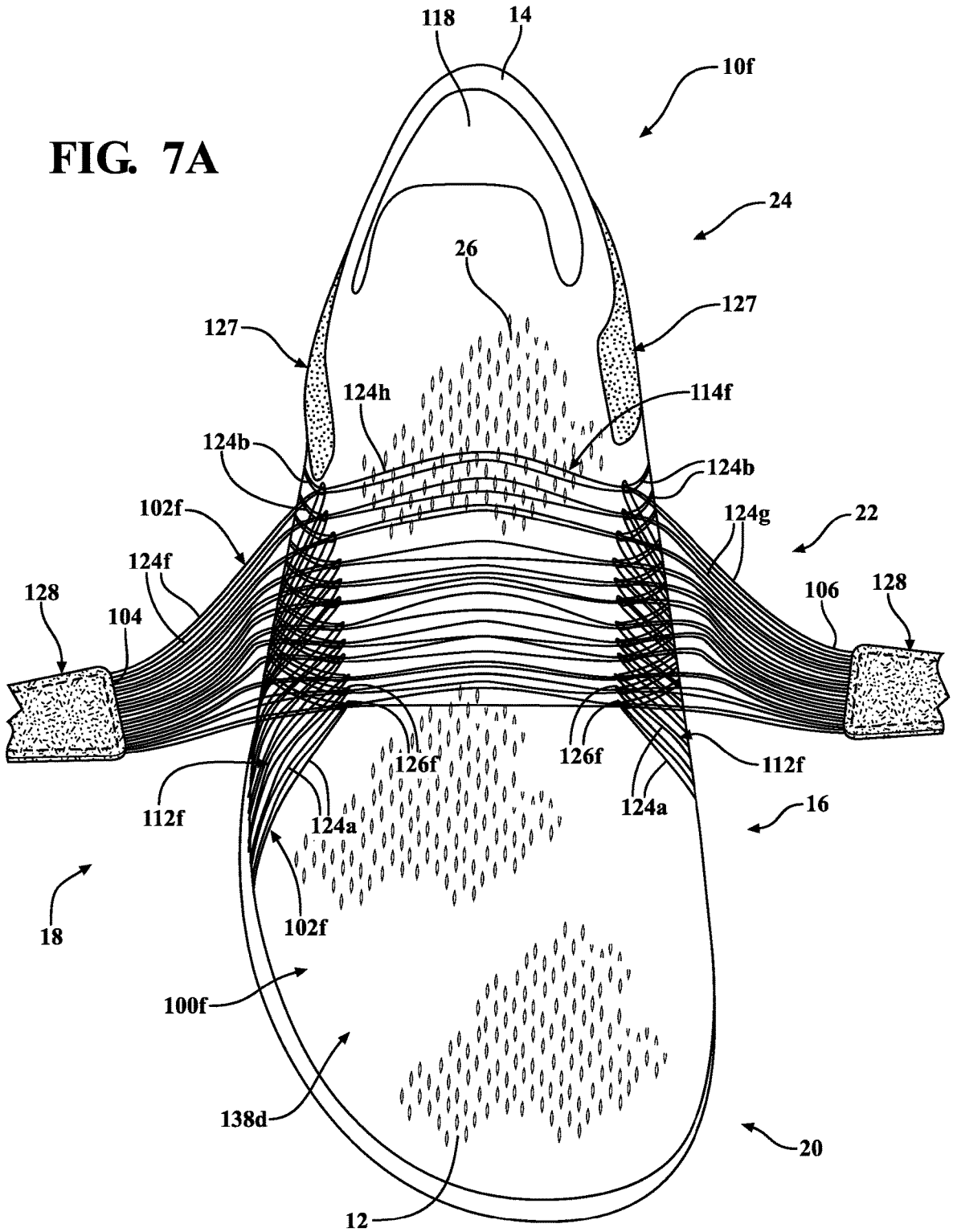
FIG. 7A is a top perspective view of an article of footwear according to the principles of the present disclosure, where an upper of the article of footwear is shown in an open configuration.
Figure 7B:
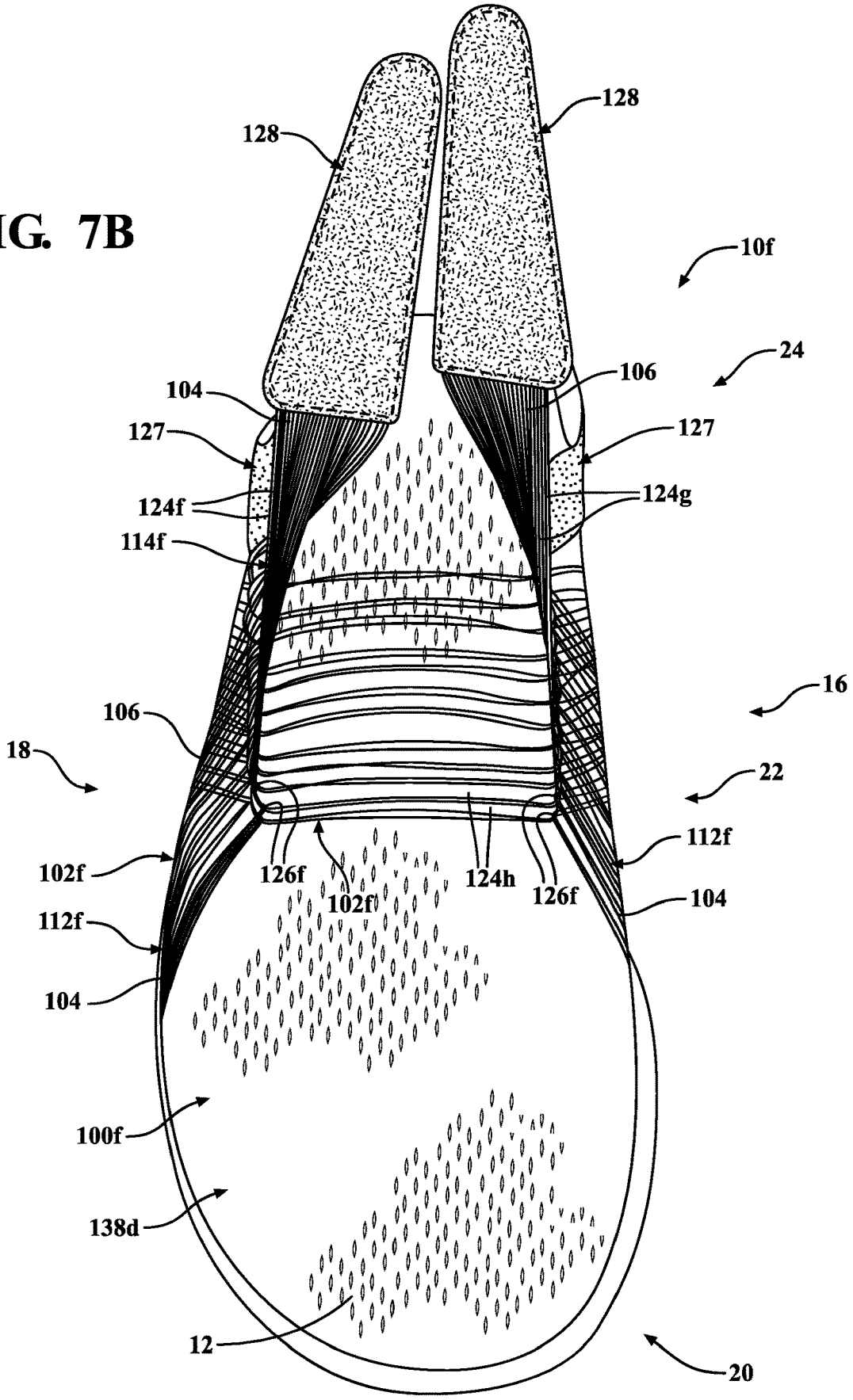
FIG. 7B is a top perspective view of the article of footwear of FIG. 7A, where the upper is shown in an intermediate configuration.
Figure 7C:
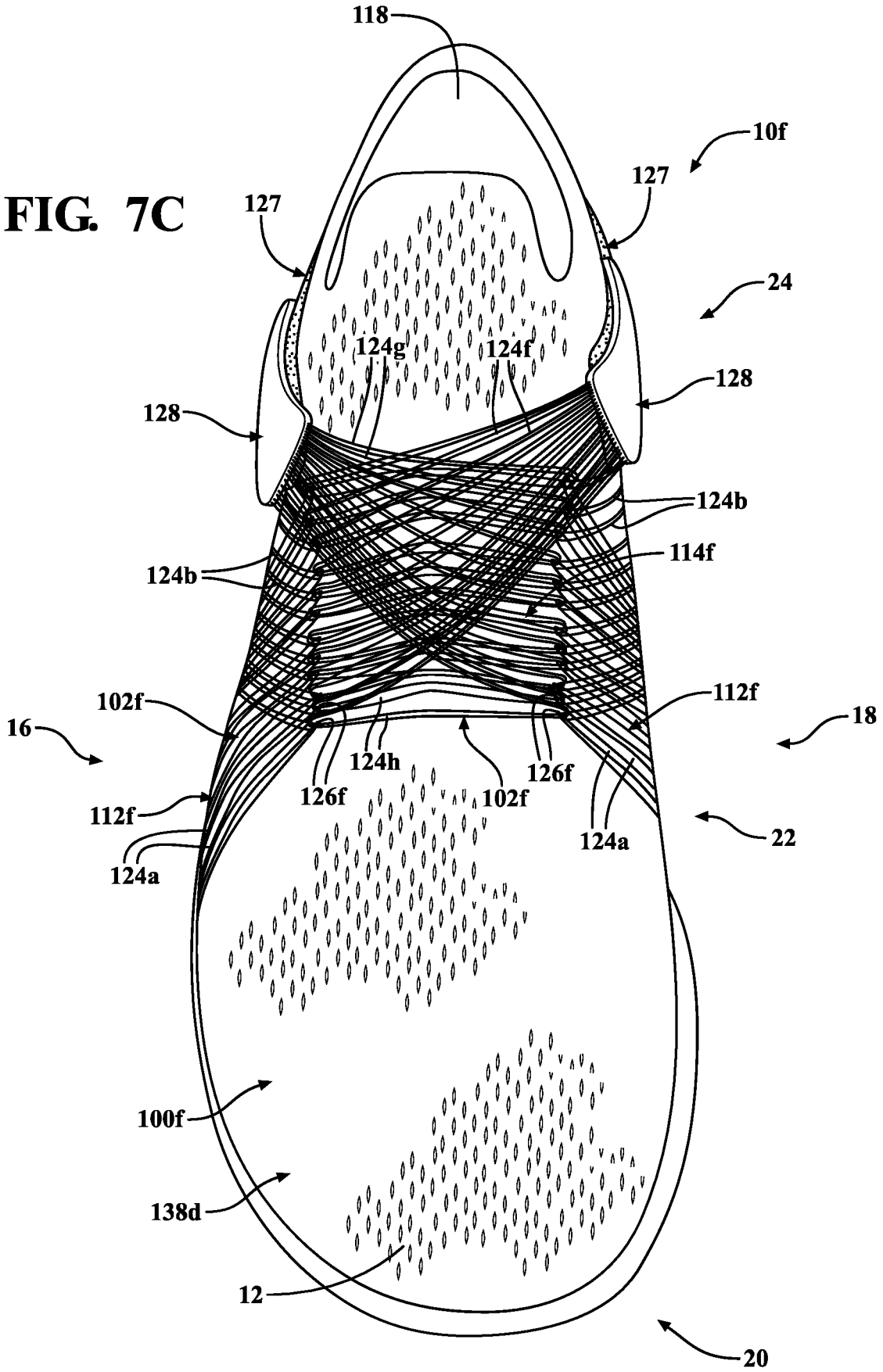
FIG. 7C is a top perspective view of the article of footwear of FIG. 7A, where the upper is shown in a closed configuration.

With particular reference to FIGS. 7A-7C, an article of footwear 10*f* is provided and includes an upper 100*f* and the sole structure 200 attached to the upper 100*f*. In view of the substantial similarity in structure and function of the components associated with the article of footwear 10 with respect to the article of footwear 10*f*, like reference numerals are used hereinafter and in the drawings to identify like components, while like reference numerals containing letter extensions are used to identify those components that have been modified.

The article of footwear 10*f* of FIGS. 7A-7C is configured substantially the same as the article of footwear 10*e* described above and shown in FIGS. 6A and 6B. For example, the article of footwear 10*f* includes a pair of fixed straps 112*f* arranged on opposite sides of the upper 100*f*, and an adjustment strap 114*f* including a first adjustable closure 128 at a first end 104 of the strands 102*f* and a second adjustable closure 128 at a second end 106 of the strands 102*f* that are configured to attach to fixed closures 127 disposed on opposite sides of the upper 100*f*. However, in this example, the strands 102*f* of the straps 112*f*, 114*f* are provided in pairs. For instance, the strands 102*f* of the fixed straps 112*f* are arranged in respective pairs each forming one of the loops 126*f*, while the strands 102*f* of the adjustment strap 114*f* are arranged in respective pairs that are routed through each one of the loops 126*f* Accordingly, the strands 102*f* are configured to provide redundancy at each of the loops 126*f*.

In use, the size and/or fit of the uppers 100-100*f* can be selectively adjusted around the foot of the wearer by adjusting a position of the adjustment straps 114-114*f* Particularly, the fit of the uppers 100-100*f* may be adjusted around the foot by detaching the adjustable closure 128-128*b* from the fixed closure 127, 127*a* so that the strands 102 of the adjustment strap(s) 114-114*f* can be pulled through the loops 126, 126*f* of the fixed straps 112-112*f* to adjust a size of the upper 100-100*f* around the foot. By forming the upper 100-100*f* with the strands 102, the weight of the upper 100-100*f* is minimized. Additionally, forming elements of the upper 100-100*f* of the individual strands 102 allows each of the elements to conform to the exterior of the foot on a strand-by-strand basis.

Figure 8A:
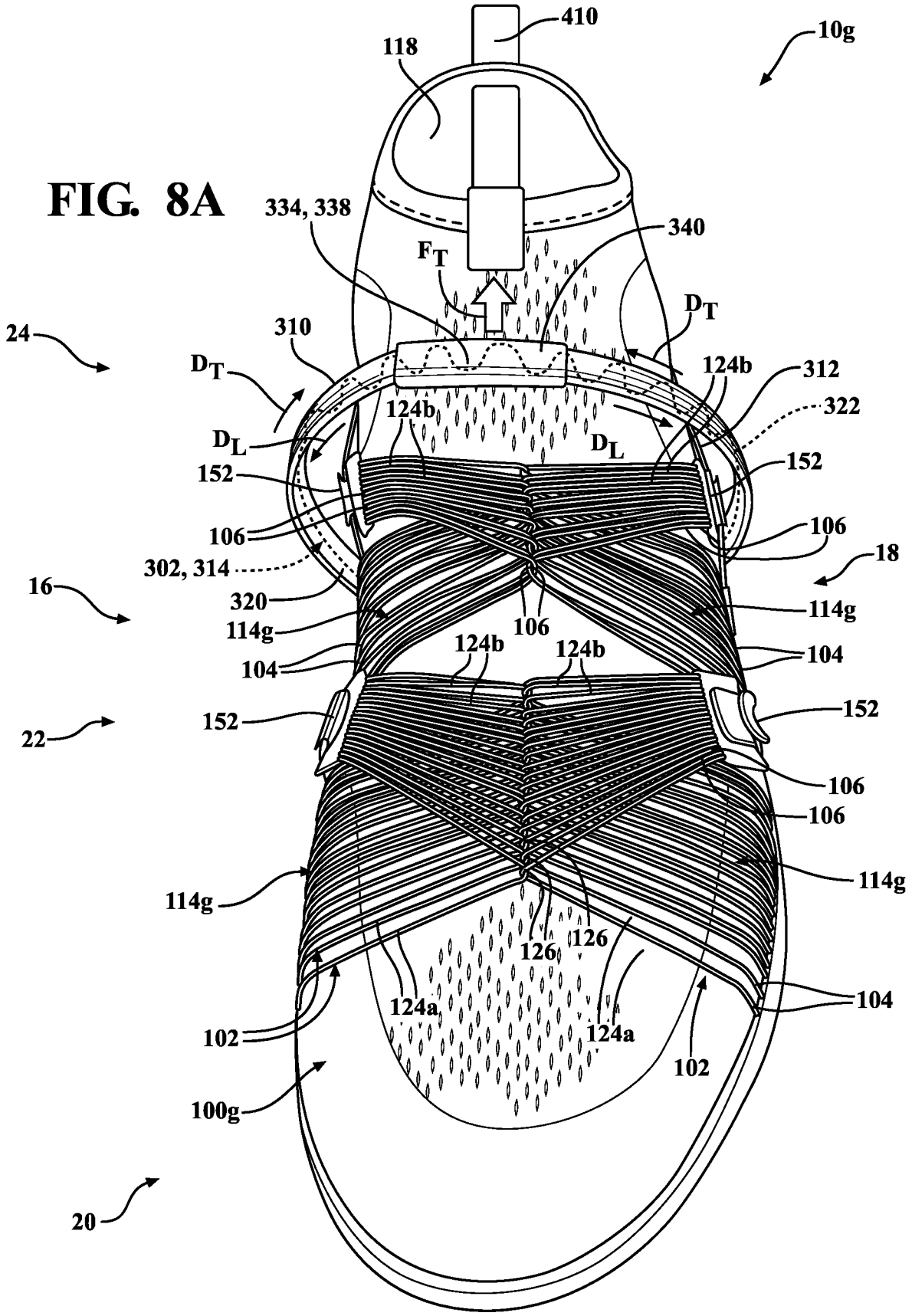
FIG. 8A is a top perspective view of an article of footwear according to the principles of the present disclosure, where an upper of the article of footwear is shown in an open configuration.
Figure 8B:
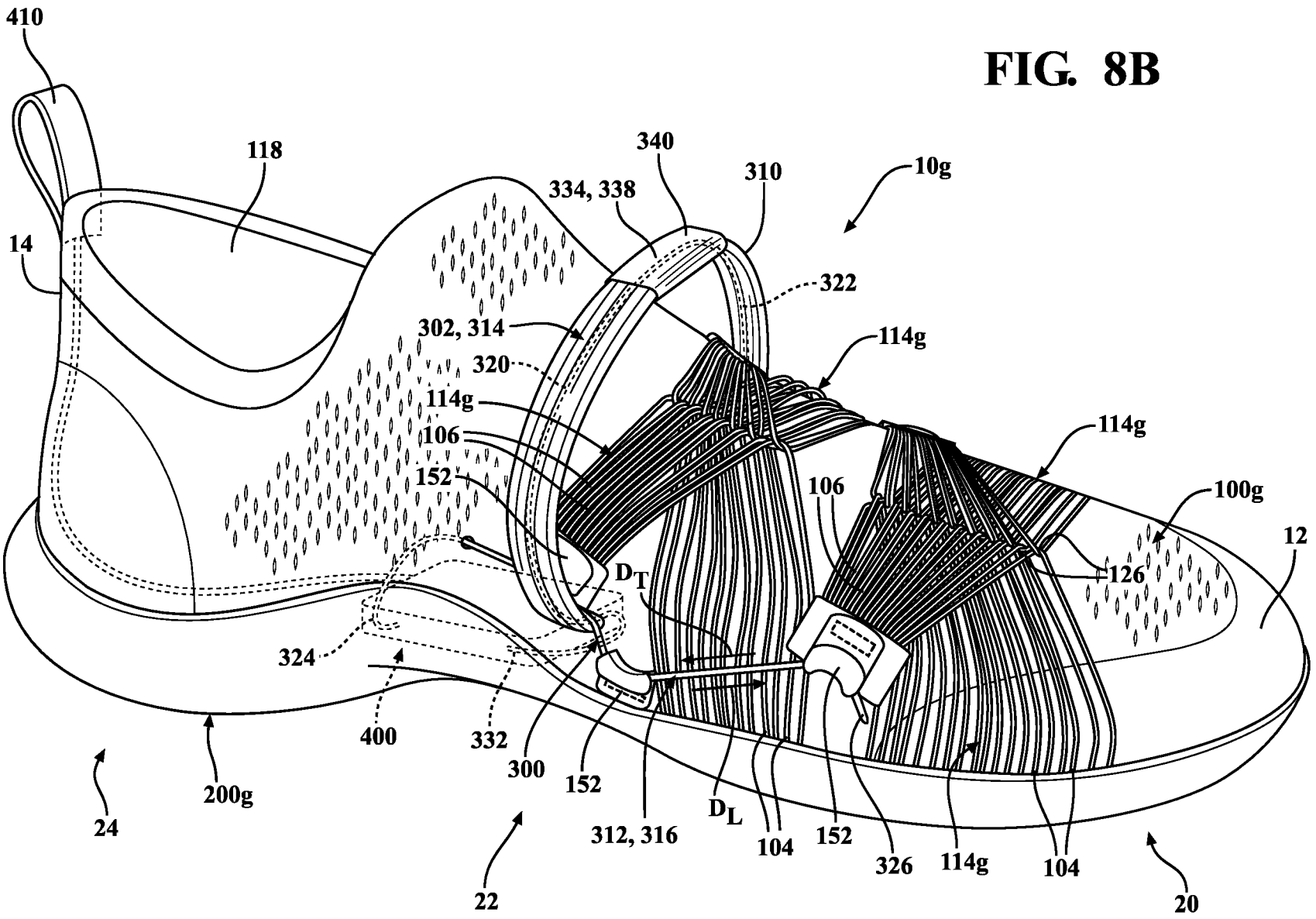
FIG. 8B is a lateral side perspective view of the article of footwear of FIG. 8A.
Figure 8C:
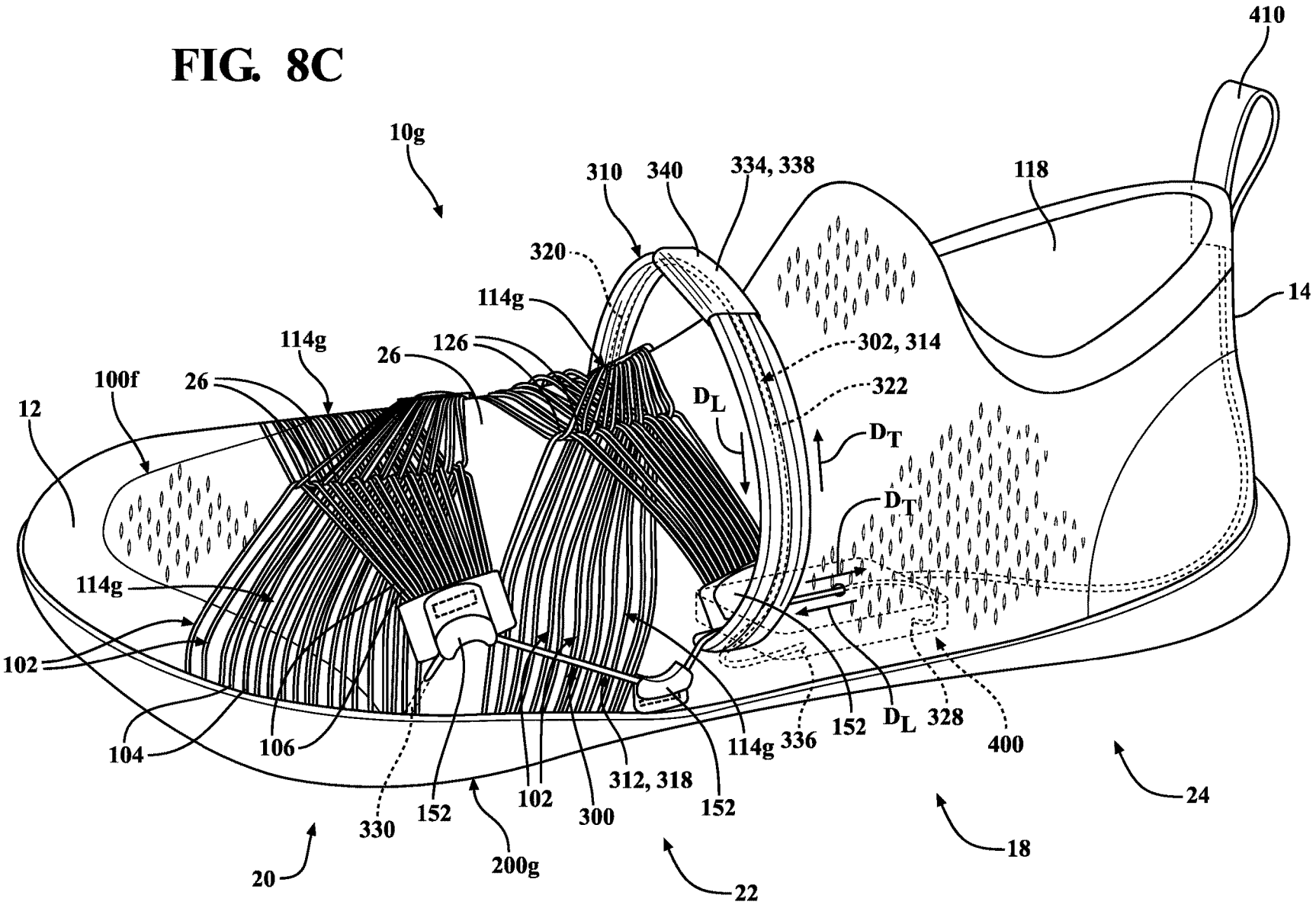
FIG. 8C is a medial side perspective view of the article of footwear of FIG. 8A.

With particular reference to FIGS. 8A-8C, an article of footwear 10*g* is provided and includes an upper 100*g* and the sole structure 200 attached to the upper 100*g*. In view of the substantial similarity in structure and function of the components associated with the article of footwear 10 with respect to the article of footwear 10*g*, like reference numerals are used hereinafter and in the drawings to identify like components, while like reference numerals containing letter extensions are used to identify those components that have been modified.

The article of footwear 10*g* further includes a tensioning system 300 and a tensioning device 400 each integrated into at least one of the upper 100*g* and the sole structure 200*g*. The tensioning system 300 includes a cable 302 routed along the upper 100*g* and configured to manage the tension of the upper 100*g*. The upper 100*g*, the tensioning system 300, and the tensioning device 400 cooperate to move the article of footwear 10*g* between a relaxed state and a tightened state. Particularly, the cable 302 is movable in a tightening direction $D_T$ to move the article of footwear 10*g* into the tightened state, and in a loosening direction $D_L$ to move the article of footwear 10*g* into the loosened state. In some implementations, the sole structure 200*g* and the upper 100*g* cooperate to provide passages and guides for routing portions of the cable 302 through the tensioning device 400. The tensioning device 400 is configured to selectively move and secure the cable 302 in the tightened state.

In this example, the upper 100*g* of the article of footwear 10*g* includes a first pair of interweaved adjustment straps 114*g* disposed in the forefoot region 20 and a second pair of interweaved adjustment straps 114*g* disposed in the mid-foot region 22. Accordingly, the upper 100*g* is configured for zonal tensioning around the foot. The adjustment straps 114*g* are configured substantially similar to the adjustment straps discussed above, and each include a plurality of parallel strands 102 extending from a first end 104 at the bite line 28 to a second end 106 attached to an adjustable closure 152. Each strap 114*g* includes a plurality of the loops 126 formed where a second segment 124*b* of the strand 102 is folded over a first segment 124*a* of the each strand 102. As shown, in each pair of the adjustment straps 114*g*, the strands 102 of one adjustment strap 114*g* are routed through the loops 126 formed by the segments 124*a*, 124*b* of the other adjustment strap 114*g*. Accordingly, a fit of the upper 100*g* is adjusted by pulling the strands 102 of one strap 114*g* through the loops 126 of the other strap 114*g*, thereby reducing an effective length of the first segments 124*a* (i.e., a distance from the first end 104 to the loops 126).

Unlike previous examples, where the adjustable closure 128 attached to the second ends 106 of the adjustment straps 114-114*e* is configured to be manually coupled to a fixed closure 127, the second ends of the adjustment straps 114*g* are attached to cable guides 152 configured to slidingly receive the cable 302 therein. Generally, the cable guides 152 are configured to convert a tensile force applied along a length of the cable 302 to directional forces to draw the ends 106 of the adjustment straps 114*g* towards the bite line 28 to tighten the upper 100*g*. The cable guides 152 include a rigid material and form an arcuate guide surface along which the cable 302 can slide.

Referring to FIGS. 8A-8C, the tensioning system 300 includes the cable 302 routed along the cable guides 152 of the upper 100*g* to move the footwear 10*g* between a tightened state and a relaxed state. The tensioning system 300 may include one or more sheaths 310 for managing slack in the cable 302. As discussed below, the sheath 310 maintains the cable 302 in a retracted state against the upper 100*g* when the upper 100*g* is in the tightened state.

The cable 302 may be highly lubricous and/or may be formed from one or more fibers having a low modulus of elasticity and a high tensile strength. For instance, the fibers may include high modulus polyethylene fibers having a high strength-to-weight ratio and a low elasticity. Additionally or alternatively, the cable 302 may be formed from a molded monofilament polymer and/or a woven steel with or without other lubrication coating. In some examples, the cable 302 includes multiple strands of material woven together.

The cable 302 includes a tensioning element 312 and a control element 314 that cooperate with the cable guides 152 of the upper 100*g* and the tensioning device 400 to move the article of footwear 10 between the tightened state and the relaxed state. The tensioning element 312 and the control element 314 may be collectively referred to as adjustment elements 312, 314. The adjustment elements 312, 314 are movable in a tightening direction $D_T$ to move the article of footwear 10 into the tightened state, and in a loosening direction $D_L$ to allow the article of footwear 10 to transition to a relaxed state. In some examples, a tightening force $F_T$ applied to the control element 314 is transmitted to at least a portion of the tensioning element 312 through the tensioning device 400 to move the tensioning element 312 in the tightening direction $D_T$.

As best shown in FIGS. 8B and 8C, the tensioning element 312 and the control element 314 may be described as including lateral strands 316, 320 and medial strands 318, 322. More specifically, the tensioning element 312 includes a medial tensioning strand 316 and a lateral tensioning strand 318, and the control element 314 also includes a medial control strand 320 and a lateral control strand 322. In the illustrated example, the medial tensioning strand 316 of the tensioning element 312 is connected to the medial control strand 320 of the control element 314 through the tensioning device 400. Similarly, the lateral tensioning strand 318 of the tensioning element 312 is connected to the lateral control strand 322 of the control element 314 through the tensioning device 400. Accordingly, positions of the medial and lateral tensioning strands 316, 318 of the tensioning element 312 may be adjusted by moving a respective one of the medial and lateral control strands 320, 322 of the control element 314.

Referring now to FIGS. 8B and 8C, the routing of the tensioning element 312 along each of the medial and lateral sides 16, 18 is shown. As best shown in FIGS. 8B and 8C, the tensioning element 312 may be described as including the lateral tensioning strand 318 and the medial tensioning strand 316. Generally, the medial tensioning strand 316 extends from the tensioning device 400 on the medial side 16 and is routed through the cable guides 152 on the ends 106 of the adjustment straps 114*g* on the medial side 16 of the upper 100*g*. Conversely, the lateral tensioning strand 318 extends from the tensioning device 400 on the lateral side 18 and is routed through the cable guides 152 on the ends 106 of the adjustment straps 114*g* on the lateral side 18 of the upper 100*g*.

As shown in FIG. 8B, on the medial side 16 of the article of footwear 10, the medial tensioning strand 316 includes a first end 324 received by the tensioning device 400 and a second end 326 at the bite line 28 on the medial side 16 in the forefoot region 20. Here, the medial tensioning strand 316 is routed from the tensioning device 400 in the outsole 200*g* to the upper. A first segment of the medial tensioning strand 316 extends from the bite line 28 in the mid-foot region 22 to a first one of the cable guides 152 attached at the ends 106 of one of the adjustment straps 114*g* on the medial side 16 in the mid-foot region 22. The medial tensioning strand 316 is then routed through a cable guide 152 fixed at the bite line 28 on the medial side 16, and then through another one of the cable guides 152 attached at the ends 106 of one of the adjustment straps 114*g* on the medial side 16 in the forefoot region 20. The medial tensioning strand 316 then extends from the cable guide 152 on the medial forefoot adjustment strap 114*g* to the second end 326 attached to the bite line 28 in the forefoot region 20.

As shown in FIG. 8C, on the lateral side 18 of the article of footwear 10, the lateral tensioning strand 318 includes a first end 328 received by the tensioning device 400 and a second end 330 at the bite line 28 on the lateral side 18 in the forefoot region 20. Here, the lateral tensioning strand 318 is routed from the tensioning device 400 in the sole structure 200*g* to the upper 100*g*. A first segment of the lateral tensioning strand 318 extends from the bite line 28 in the mid-foot region 22 to a first one of the cable guides 152 attached at the ends 106 of one of the adjustment straps 114*g* on the lateral side 18 in the mid-foot region 22. The lateral tensioning strand 318 is then routed through a cable guide 152 fixed at the bite line 28 on the lateral side 18, and then through another one of the cable guides 152 attached at the ends 106 of one of the adjustment straps 114*g* on the lateral side 18 in the forefoot region 20. The lateral tensioning strand 318 then extends from the cable guide 152 on the lateral forefoot adjustment strap 114*g* to the second end 326 attached to the bite line 28 in the forefoot region 20.

As described above and shown in FIGS. 8A and 8B, the medial control strand 320 of the control element 314 is connected to the medial tensioning strand 316 of the tensioning element 312 through the tensioning device 400, and extends from a first end 332 at the tensioning device 400 to a second end 334 along the upper 100*g*. Particularly, the medial control strand 320 of the control element 314 is routed from the tensioning device 400 to the bite line 28, and then along the side of the upper 100*g* to the instep region 26.

Likewise, as shown in FIGS. 8A and 8C, the lateral control strand 322 of the control element 314 is connected to the lateral tensioning strand 318 of the tensioning element 312 through the tensioning device 400, and extends from a first end 336 at the tensioning device 400 to a second end 338 along the upper 100*g*. The lateral control strand 322 of the control element 314 is routed from the tensioning device 400 to the bite line 28, then along the lateral side 18 of the upper 100*g* to the instep region 26.

Referring to FIG. 8A, the second end 334 of the lateral control strand 322 may be connected to the second end 338 of the medial control strand 320 at the instep region 26 adjacent to an ankle opening of the upper 100*g*, such that the lateral control strand 322 and the medial control strand 320 form a continuous loop over the instep region 26 of the upper 100*g*. In other examples, the second ends 334, 338 of the lateral control strand 322 and the medial control strand 320 may be indirectly connected to each other by an intermediate connecting element (not shown).

A portion of the control element 314 that extends around the upper 100*g* may be enclosed within one or more of the sheaths 310. Each sheath 310 may be formed from a material and/or a weave that allows the sheath 310 and the control element 314 to move from a relaxed state to a stretched or expanded state when the control element 314 is moved in a direction away from the upper 100*g* by way of the tightening force $F_T$ (i.e., when the control element 314 is moved in the tightening direction $D_T$). When the tightening force $F_T$ is removed, the material and/or weave of the sheath 310 automatically causes the sheath 310 to contract to the relaxed state and accommodate bunching of the control element 314 therein, as shown in FIG. 8A. As shown, the control element 314 is routed through the sheath 310 and around the instep region 26 of the upper 100*g*. In the example shown, the connected second ends 334, 338 of the control element 314 and/or the sheath 310 may form tightening grip 340 configured to allow a user to apply the tightening force $F_T$ to pull the control element 314 away from the upper 100*g*, thereby causing each of the control element 314 and the tensioning element 312 to move in the tightening direction $D_T$. Here, the tightening grip 340 is defined by the sheath 310.

The upper 100*g* is moveable between a relaxed state and a tightened state by adjusting the tensioning element 312 along the sides 16, 18 of the upper 100*g*. As shown, the cable 302 of the tensioning system 300 can be moved in the tightening direction $D_T$ by applying a tightening force $F_T$ to the control element 314. For instance, a user may apply the tightening force $F_T$ to the control element 314 by pulling the tightening grip 340 and the sheath 310 away from the upper 100*g*, thereby moving the control element 314 in the tightening direction $D_T$. Here, the tightening force $F_T$ is applied to each of the control strands 320, 322 and is transmitted to respective ones of the tensioning strands 316, 318 through the tensioning device 400. The tightening force $F_T$ pulls the tensioning strands 316, 318 in the tightening direction to draw the cable guides 152 attached to the ends 106 of the adjustment straps 114*g* towards the bite line 28. As the ends 106 of the adjustment straps 114*g* are pulled towards the bite line 28, the strands 102 of each one of the adjustment straps 114*g* are pulled through the loops 126 of the other one of the adjustment straps 114*g* in each pair to shorten effective lengths of the first segments 124*g*, which results in an the adjustment straps 114*g* tightening around the enclosure 138*d* of the upper 100*g*.

The locking device or tensioning device 400 may be disposed within a cavity of the sole structure 200*g*, and may be biased to a locked state to restrict movement of the adjustment elements 312, 314 in their respective loosening directions $D_L$. The tensioning element 312 and the control element 314 each approach and pass through a housing 402 of the tensioning device 400 from opposite directions. In some configurations, the tensioning device 400 permits movement of the adjustment elements 312, 314 in the tightening directions $D_T$ while in the locked state.

The release cord 404 of the tensioning device 400 is operable to move the locking device 400 between an unlocked state and the locked state so that the cable 302 can be selectively moved in the tightening direction $D_T$ and loosening direction $D_L$. The release cord 404 is routed from a first end 406 at the tensioning device 400 to a second end 408 attached to a release grip 410 at the posterior end of the upper 100*g*. As discussed previously, the release cord 404 is routed from the recess 124 to the upper 100*g* through a release cord channel in the sole structure 200. In the illustrated example, the release cord channel extends through the heel region 24, such that the release cord 404 is routed up the posterior end 14 of the upper 100*g*.

Figure 9:
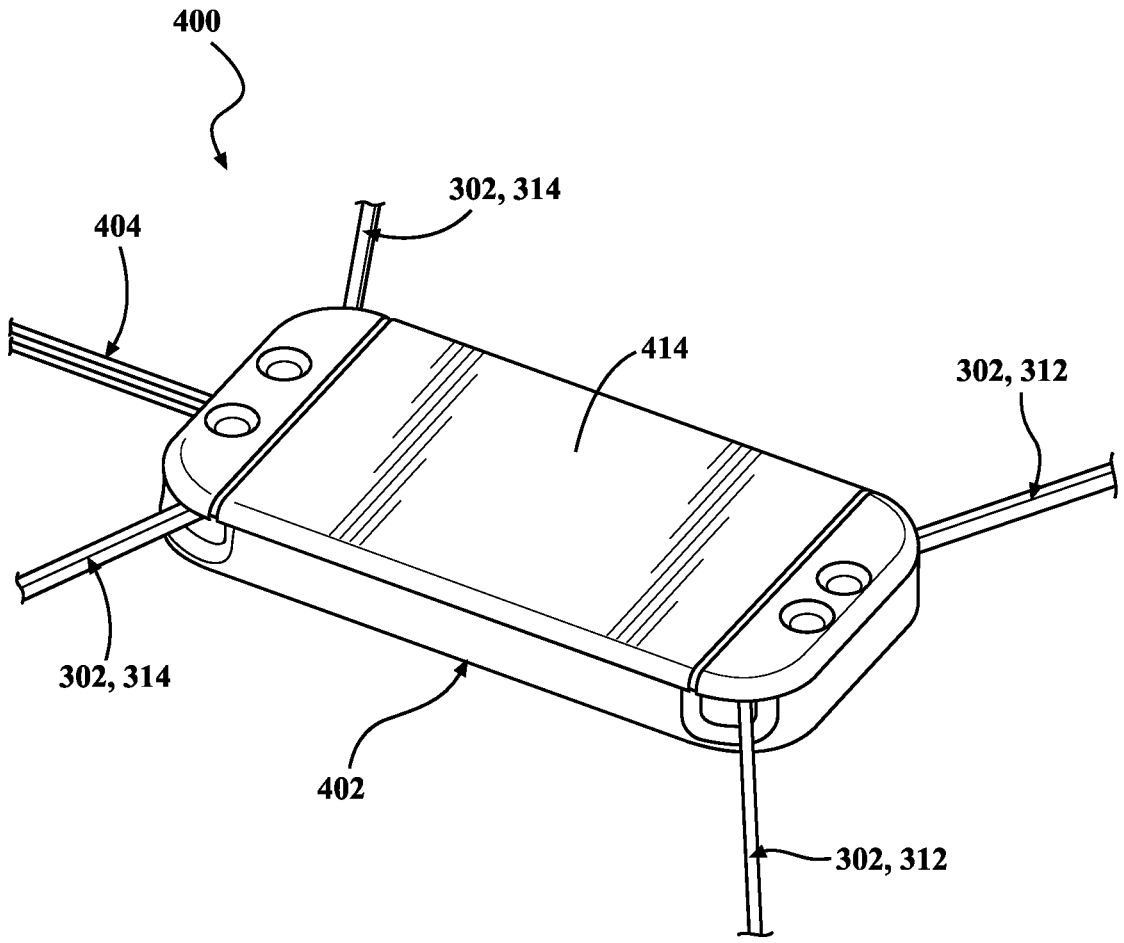
FIG. 9 is a perspective view of an example of a tensioning device according to the principles of the present disclosure.
Figure 10:
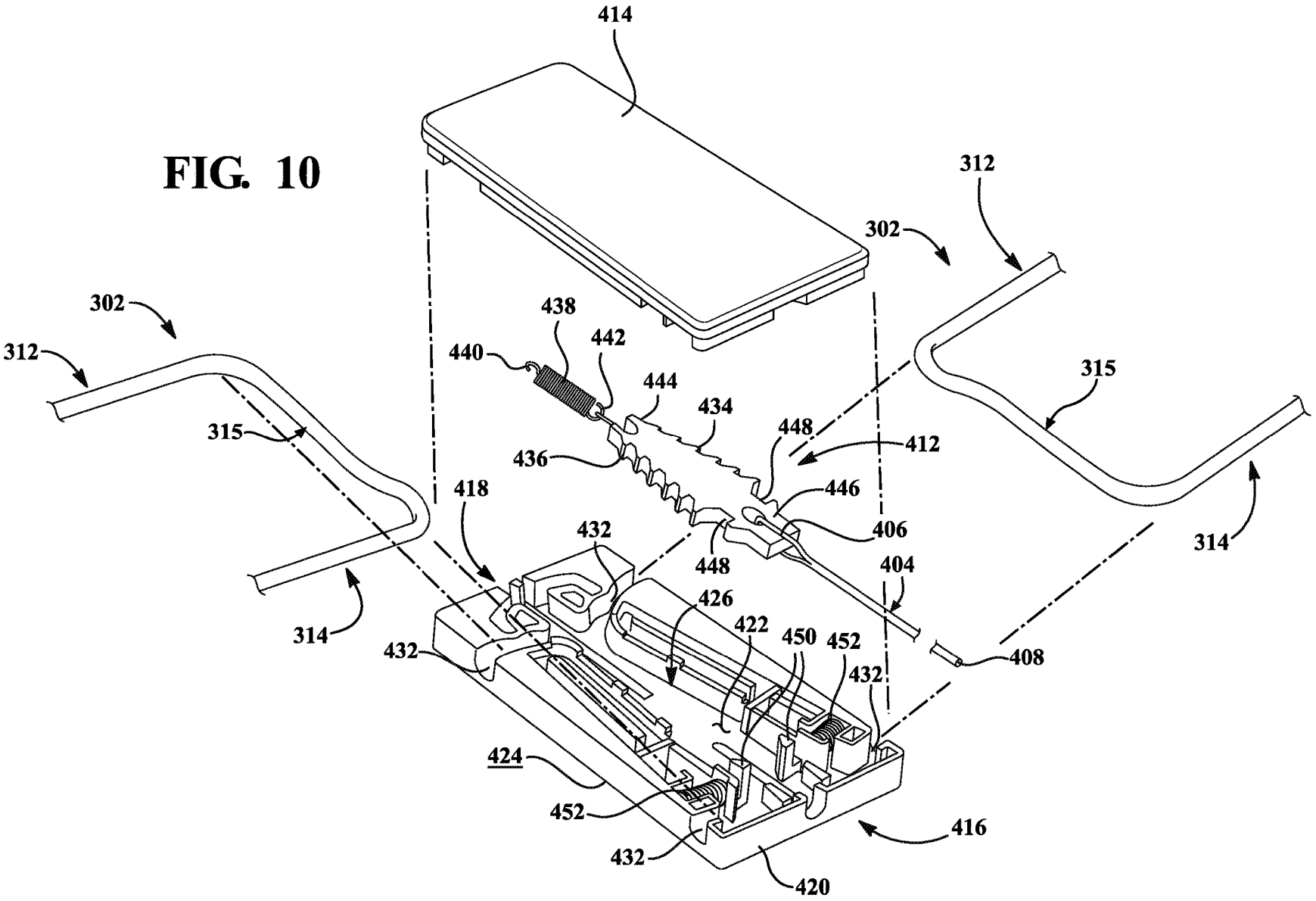
FIG. 10 is an exploded view of the tensioning device of FIG. 10.

Referring to FIGS. 9-12, in some implementations, the tensioning device 400 includes the housing 402 and a locking member or lock member 412 slidably disposed within the housing 402 and enclosed by a lid 414 fastened to the housing 402. FIG. 10 provides an exploded view of the tensioning device 400 of FIG. 9 showing the locking member 412 and the lid 414 removed from the housing 402. The housing 402 defines a length extending between a first end 416 and a second end 418. The housing 402 includes a base portion 420 having a cable-receiving surface 422 and a mounting surface 424 disposed on an opposite side of the base portion 420 than the cable-receiving surface 422 and opposing the exterior surface of the upper 100*g*. The lid 414 opposes the cable-receiving surface 422 of the base portion 420 to define a locking member cavity 426 therebetween that is configured to receive the locking member 412 and a portion of the tensioning system 300. In some configurations, the locking member cavity 426 is bounded by a first engagement surface 428 and a second engagement surface 430 (FIGS. 11 and 12) that converge toward one another such that the locking member cavity 426 is associated with a wedge-shaped configuration tapering toward the second end 418 of the housing 402. Accordingly, the first engagement surface 428 and the second engagement surface 430 include corresponding sidewalls of the housing 402 converging toward one another and extending between the lid 414 and the cable-receiving surface 422 of the base portion 420 to define the locking member cavity 426.

As discussed above, the cable 302 of the tensioning system 300 may include a tensioning element 312 and a control element 314, which are connected to each other by a locking element 315 that extends through the locking member cavity 426 and includes a first portion extending along the first engagement surface 428 and a second portion extending along the second engagement surface 430. The tensioning element 312 exits out of corresponding slots 432 (FIGS. 11 and 12) formed through opposing sidewalls of the housing 402 proximate to the first end 416. The control element 314 exits out of corresponding slots 432 (FIGS. 11 and 12) formed through the opposing sidewalls of the housing 402 proximate to the second end 418.

In some implementations, the locking member 412 includes a first lock surface 434 opposing the first engagement surface 428 of the housing 402 and a second lock surface 436 opposing the second engagement surface 430 of the housing 402 when the locking member 412 is disposed within the locking member cavity 426 of the housing 402. In some examples, the first lock surface 434 and the second lock surface 436 converge toward one another. Additionally or alternatively, the first lock surface 434 may be substantially parallel to the first engagement surface 428 and the second lock surface 436 may be substantially parallel to the second engagement surface 430. In the example shown, the lock surfaces 434, 436 include projections or teeth each having an angled surface to permit movement by tensioning system 300 in the tightening direction $D_T$ (i.e., when the tightening force $F_T$ is applied to control element 314) while restricting movement by the tensioning system 300 by gripping the locking element 315 in the loosening direction $D_L$ when the locking member 412 is in the locked state. A biasing member 438 (e.g., a spring) may include a first end 440 attached to the second end 418 of the housing 402 and a second end 442 attached to a first end 444 of the locking member 412 to attach the locking member 412 to the housing 402.

In some implementations, the locking member 412 is slidably disposed within the housing 402 and is movable between a locked position (FIG. 11) associated with the locked state of the tensioning device 400 and an unlocked position (FIG. 12) associated with the unlocked state of the tensioning device 400. In some examples, the release mechanism 404 (e.g., release cord 404) moves the locking member 412 from the locked position (FIG. 11) to the unlocked position (FIG. 12). The locking member 412 may include a tab portion 446 extending from an opposite end of the locking member 412 than the first end 444. In one configuration, the first end 406 of the release cord 404 attaches to the tab portion 446 of the locking member 412. The tab portion 446 may include a pair of retention features or recesses 448 formed in corresponding ones of the first lock surface 434 and the second lock surface 436 and selectively receiving one or more retention features 450 associated with the housing 402 to maintain the tensioning device 400 in the unlocked state. The retention features 450 associated with the housing 402 may include a first retention feature 450 and a second retention feature 450 disposed on opposite sides of the housing 402, whereby the retention features 450 are biased inward toward the cavity 426 and one another by corresponding biasing members 452. The retention features 450 may be projections that are integrally formed with the housing 402 such that the retention features 450 act as living hinges movable between a retracted state (FIG. 11) and an extended state (FIG. 12).

Figure 11:
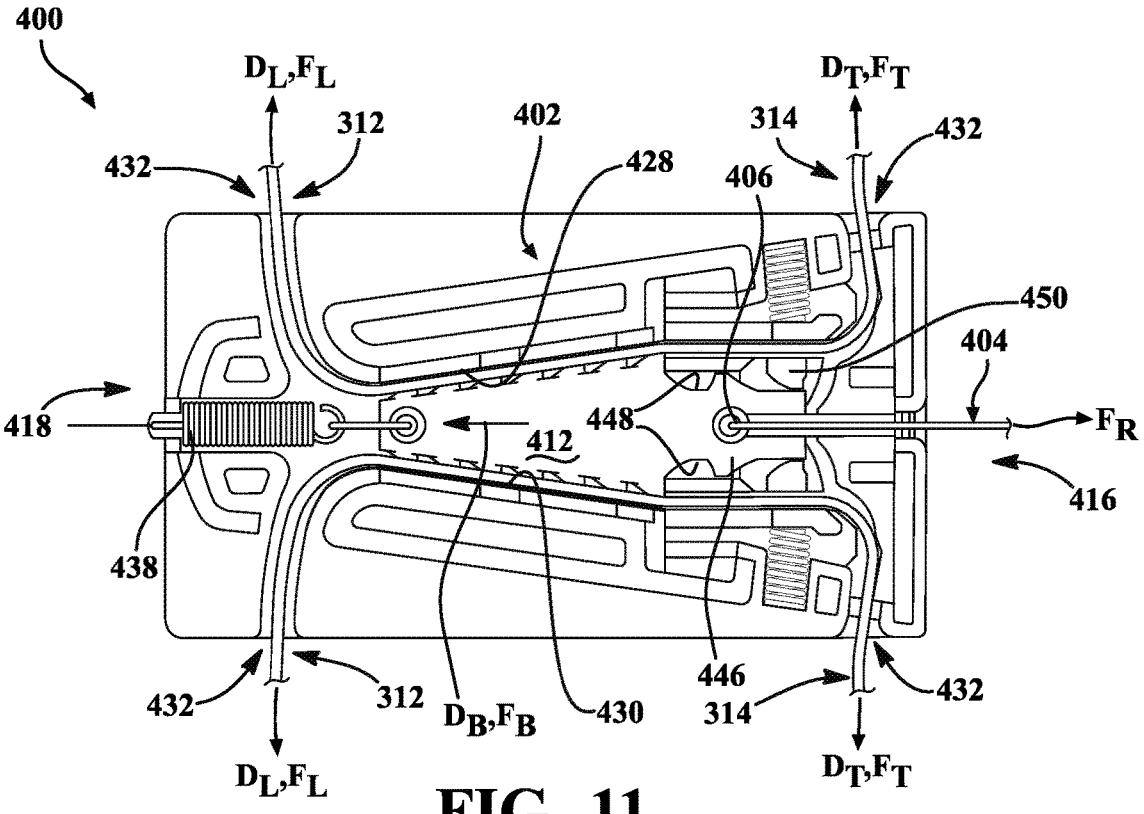
FIG. 11 is a top view of the tensioning device of FIG. 10, showing a housing having a lid removed to expose a locking member slidably disposed within the housing when the locking member is in a locked position.
Figure 12:
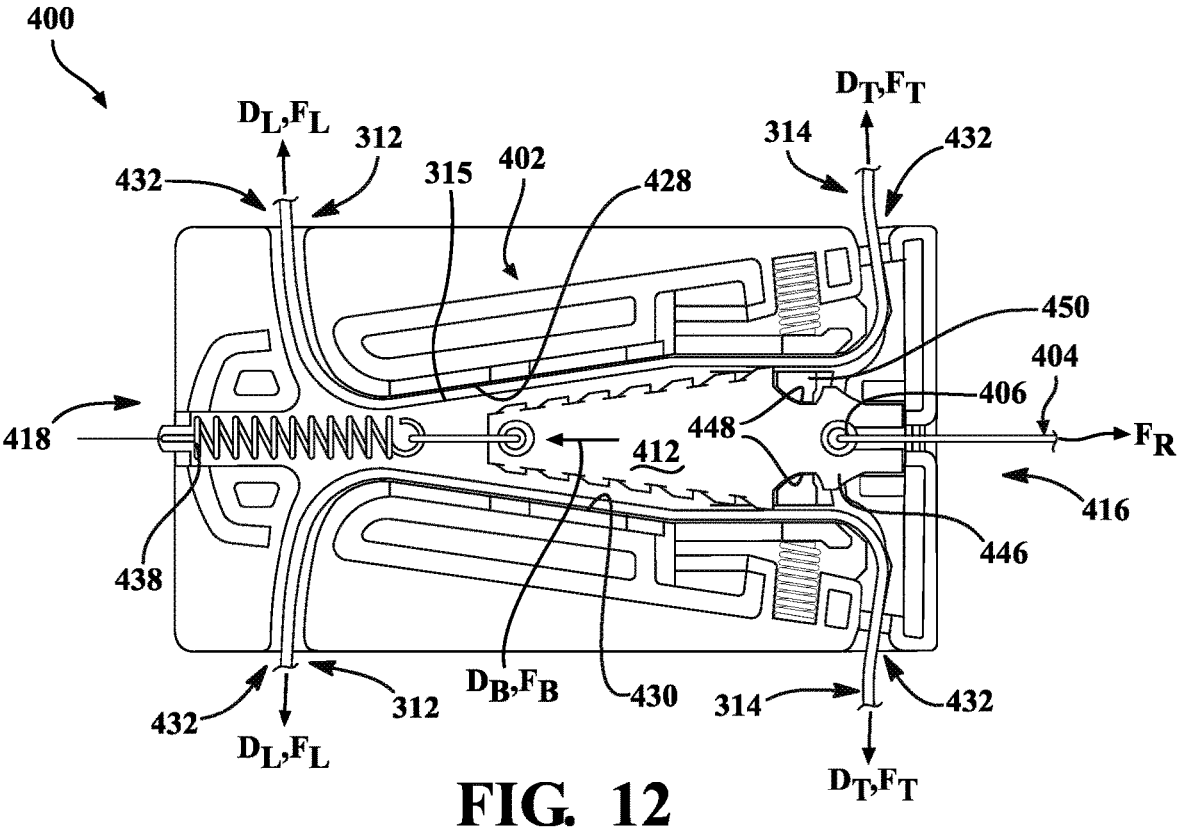
FIG. 12 is a top view of the locking device of FIG. 10, showing a housing having a lid removed to expose a locking member slidably disposed within the housing when the locking member is in an unlocked position.

FIG. 11 provides a top view of the tensioning device 400 of FIG. 9 with the lid 414 removed to show the locking member 412 disposed within the cavity 426 of the housing 402 while in the locked position. In some examples, the locking member 412 is biased into the locked position. For instance, FIG. 11 shows the biasing member 438 exerting a biasing force $F_B$ (represented in a direction DB) upon the locking member 412 to urge the first end 444 of the locking member 412 toward the second end 418 of the housing 402, and thereby bias the locking member 412 into the locked position. While in the locked position, the locking member 412 restricts movement of the tensioning system 300 relative to the housing 402 by pinching the locking element 315 of the tensioning system 300 between the lock surfaces 434, 436 and the engagement surfaces 428, 430. Accordingly, the locked position of the locking member 412 restricts the tensioning system 300 from moving in the loosening direction $D_L$. In the example shown, the locking member 412 permits movement of the tensioning system 300 when the tightening force $F_T$ is applied to the tightening grip 340, as this direction causes the tensioning system 300 to apply a force on the locking member 412 due to the generally wedge shape of the locking member 412, thereby moving the locking member 412 into the unlocked state. The locking member 412 automatically returns to the locked state once the force applied to the tightening grip 340 is released due to the forces imparted on the locking member 412 by the biasing member 438.

FIG. 12 provides a top view of the tensioning device 400 of FIG. 9 with the lid 414 removed to show the locking member 412 disposed within the cavity 426 of the housing 402 while in the unlocked position. In some examples, the release cord 404 attached to the tab portion 446 of the locking member 412 applies a release force $F_R$ upon the locking member 412 to move the locking member 412 away from the first engagement surface 428 and the second engagement surface 430 relative to the housing 402. Here, the release force $F_R$ is sufficient to overcome the biasing force $F_B$ of the biasing member 438 to permit the locking member 412 to move relative to the housing 402 such that the pinching upon the locking element 315 of the tensioning system 300 between the lock surfaces 434, 436 and the engagement surfaces 428, 430 is released. In some examples, the biasing force $F_B$ causes the locking member 412 to transition back to the locked position when the release force $F_R$ applied by the release cord 404 is released. The release cord 404 may apply the release force $F_R$ when a release force $F_R$ of sufficient or predetermined magnitude is applied to pull the release cord 404 away from the upper 100*g* relative to the view of FIG. 12.

While in the unlocked position, the locking member 412 permits movement of the tensioning system 300 relative to the housing 402 by allowing the locking element 315 of the tensioning system 300 to freely move between the lock surfaces 434, 436 and the engagement surfaces 428, 430. The unlocked position of the locking member 412 permits movement of the tensioning system 300 in both the tightening direction $D_T$ and the loosening direction $D_L$ when the forces $F_T$, $F_L$ are applied to respective ones of the control element 314 and the tensioning element 312.

In some examples, a sufficient magnitude and/or duration of the release force $F_R$ applied to the release cord 404 causes the release cord 404 to apply the release force $F_R$ (FIG. 12) upon the locking member 412 in a direction opposite the direction of the biasing force $F_B$ (FIG. 11) such that the locking member 412 moves away from the engagement surfaces 428, 430 relative to the housing 402 and toward the first end 416 of the housing 402. At least one of the retention features 450 of the housing 402 may engage the retention feature 448 of the locking member 412 when release force $F_R$ moves the locking member 412 a predetermined distance away from the first engagement surface 428 and the second engagement surface 430 of the housing 402. Here, engagement between the retention feature 448 of the locking member 412 and the at least one retention feature 450 of the housing 402 maintains the locking member 412 in the unlocked position once the release force $F_R$ is released. The biasing force $F_B$ of the biasing member 438 and the forces exerted by the pair of biasing members 452 on the retention features 450 lock the retention feature 448 of the locking member 412 into engagement with the retention features 450 of the housing 402 after the locking member 412 moves the predetermined distance and the release force $F_R$ is no longer applied.

In some scenarios, a release force $F_R$ associated with a first magnitude may be applied to the release cord 404 to move the locking member 412 away from the engagement surfaces 428, 430 by a distance less than the predetermined distance such that the retention features 448, 450 do not engage. In these scenarios, the release force $F_R$ associated with the first magnitude can be maintained when it is desirable to move the tensioning system 300 in the loosening direction $D_L$ or the tightening direction $D_T$ (e.g., by applying the tightening force $F_T$ to the tightening grip 340) for adjusting the fit of the interior void 118 around the foot. Once the desired fit of the interior void 118 around the foot is achieved, the release force $F_R$ can be released to cause the locking member 412 to transition back to the locked position so that movement of the tensioning system 300 is restricted in the loosening direction $D_L$ and the desired fit can be sustained. It should be noted that even when the locking member 412 is in the locked position, the tensioning system 300 can be moved in the tightening direction $D_T$. As such, once the release force $F_R$ is released and a desired fit is achieved, the locking member 412 automatically retains the desired fit by locking a position of the tensioning system 300 relative to the housing 402.

In other scenarios, a release force $F_R$ associated with a second magnitude greater than the first magnitude can be applied to the release cord 404 to move the locking member 412 the predetermined distance away from the engagement surfaces 428, 430 to cause the corresponding retention features 448, 450 to engage. Engagement of the retention features 448, 450 is facilitated by providing the retention features 450 with a tapered edge that opposes the locking member 412 to allow the locking member 412 to more easily move the retention features 450 against the biasing force $F_B$ imparted thereon by the biasing members 452 when the release cord 404 is pulled the predetermined distance. In these scenarios, engagement between the corresponding retention features 448, 450 maintains the locking member 412 in the unlocked position when the release force $F_R$ is released.

The locking member 412 is returned to the locked position when a tightening force $F_T$ is applied to the control element 314. Namely, when a force is applied to the medial and lateral control strands 320, 322, these control strands 320, 322 are placed in tension which, in turn, exerts a force on the biasing members 452 via the retention features 450, as the control strands 320, 322 pass through a portion of the retention features 450. In so doing, the retention features 450 compress the biasing members 452 and, as such, cause the retention features 450 to move away from one another and disengage the retention features 448 of the locking member 412, thereby allowing the biasing member 438 to return the locking member 412 to the locked position.

In use, the article of footwear 10*g* can be selectively moved between a relaxed state and a tightened state using the tensioning system 300 and tensioning device 400. With the footwear 10*g* initially provided in a relaxed state, an effective length of the tensioning strands 316, 318 of the tensioning element 312 (i.e., the lengths from the first ends 324, 328 to the second ends 326, 330) will be maximized, such that the tensioning element 312 and the adjustment straps 114*g* are in a relaxed state about the upper 100*g*, while an effective length of the control strands 320, 322 of the control element 314 (i.e., the lengths from the first ends 332, 336 to the second ends 334, 338) is minimized. Accordingly, a foot of a user can be inserted into the interior void 118 of the footwear 10*g* with the materials of the upper 100*g* allowing the upper 100*g* to stretch to accommodate the foot therein.

With the foot of the user inserted within the interior void 118 of the upper 100*g* the tensioning system 300 can be moved to a tightened state by the user to secure the footwear 10*g* to the foot. As discussed above, the tensioning system 300 is moved to the tightened state by applying a tightening force $F_T$ to the tightening grip 340 of the control element 314, thereby causing the control element 314 to move in the tightening direction $D_T$. As the control element 314 moves in the tightening direction $D_T$, the cable 302 is pulled through the housing 402 of the tensioning device thereby causing the effective lengths of the tensioning strands 316, 318 of the tensioning element 312 to be reduced. Accordingly, the cable guides 152 on the ends of the adjustment straps 114*g* are drawn towards the bite line 28 to tighten the upper 100*g*.

As discussed above, when the tensioning element 312 is moved in the tightening direction $D_T$, the medial and lateral tensioning strands 316, 318 distribute the tightening force $F_T$ to the free ends 106 of the adjustment straps 114*g* to draw the adjustment straps 114*g* tight over the throat. Simultaneously, the effective length of the control element 314 may be increased when the tensioning system 300 is moved to the tightened state. However, the control element 314 is maintained in a taut position against the upper 100*g* by the elasticity of the sheath 310, which accommodates the increased effective length of the control element 314 by allowing the control element 314 to "bunch" within the sheath 306 when the sheath 310 is contracted.

When a user desires to remove the article of footwear 10*g* from the foot, the tensioning system 300 may be moved to the loosened state to allow the upper 100*g* to be relaxed around the foot. Initially, the tensioning device 400 must be moved to the unlocked state by applying a sufficient release force $F_R$ to overcome the biasing force $F_B$ of the biasing member 438, as discussed above. Once the tensioning device 400 is moved to the unlocked state, the cable 302 can be pulled in the loosening direction $D_L$ through the housing 402 of the tensioning device by pulling the article of footwear 10 from the foot of the user, which inherently causes the upper to expand and increases the effective lengths of the tensioning strands 316, 318 of the tensioning element 312.

Figure 13:
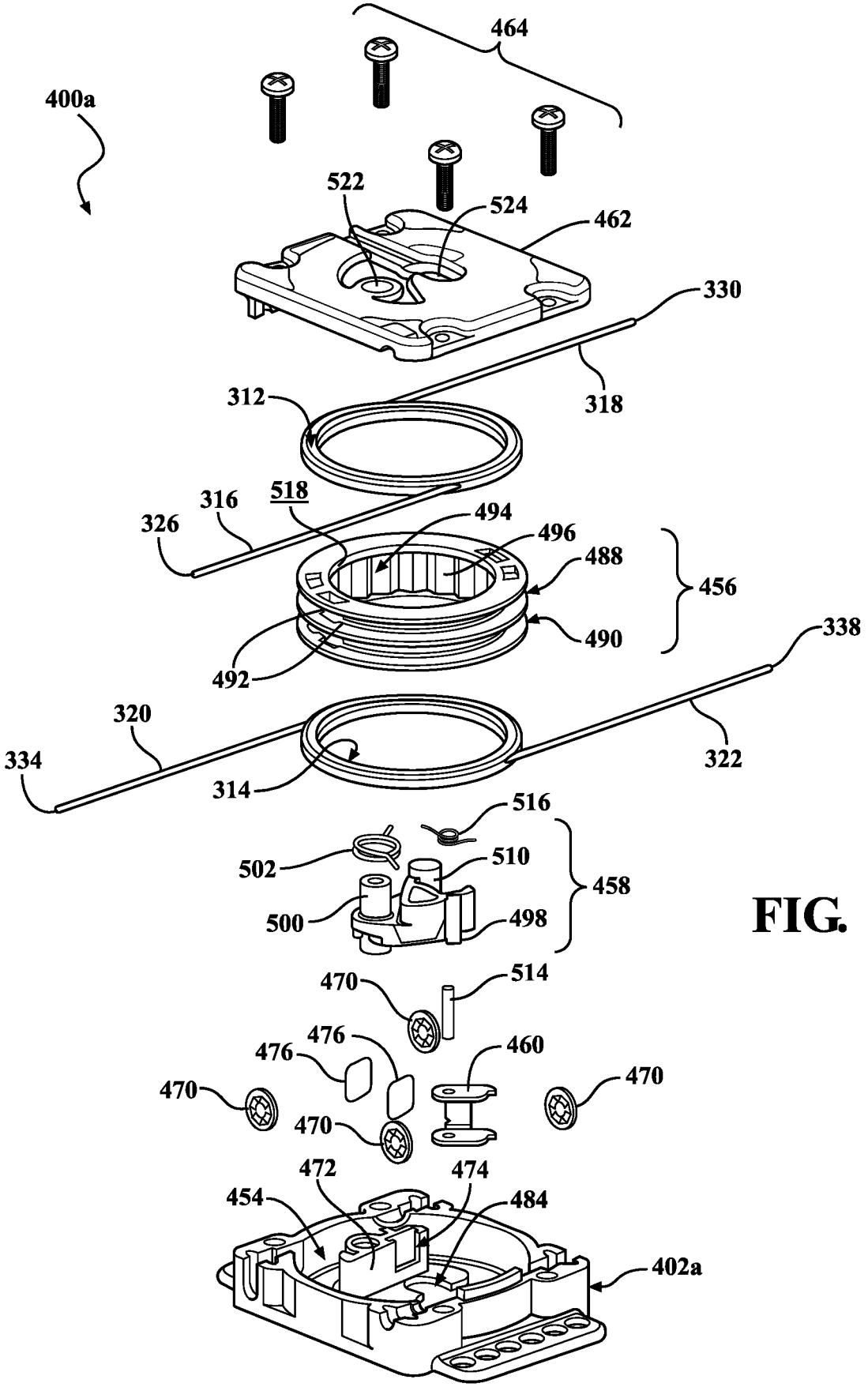
FIG. 13 is an exploded view of a tensioning device in accordance with the principles of the present disclosure.

With reference to FIGS. 13-17, another example of a manual tensioning device 400*a* is shown, where the tensioning device 400*a* is embodied as a rotary mechanism. FIG. 13 provides an exploded view of the tensioning device 400*a*, showing a housing 402*a* defining a cavity 454 configured to rotatably receive a spool 456, a first pawl 458, and a second pawl 460. The tensioning device 400*a* may include a lid 462 fastened to the housing 402*a* to prevent access to the cavity 454 when the lid 462 is fastened to the housing 402*a* and to allow access to the cavity 454 when the lid 462 is removed from the housing 402*a*. One or more fasteners 464 may extend through the lid 462 and fasten with threaded holes 466 in the housing 402*a* to secure the lid 462 to the housing 402*a*.

The housing 402*a* defines a plurality of retainer slots 468 each configured to receive and support a respective cable retainer 470 through which the cable adjustment elements are routed into the cavity 454 of the housing 402*a*. The housing 402*a* may support a plurality of the cable retainers 470 such that the ends of the adjustment elements 312, 314 each extend through a respective one of the cable retainers 470.

As described in greater detail below, the housing 402*a* may further include a retaining wall 472 disposed within the cavity 454. The retaining wall 472 is configured to cooperate with the first pawl 458. The retaining wall 472 may further include a tactile slot 474 configured to receive one or more tactile domes 476. Described in greater detail below with reference to FIGS. 15-17, the first pawl 458 may engage the tactile dome(s) 476 to provide a click or other sound that indicates the spool 456 has changed positions relative to the housing 402*a* and/or the tensioning device 400*a* has transitioned from the locked state to the unlocked state.

Figure 15:
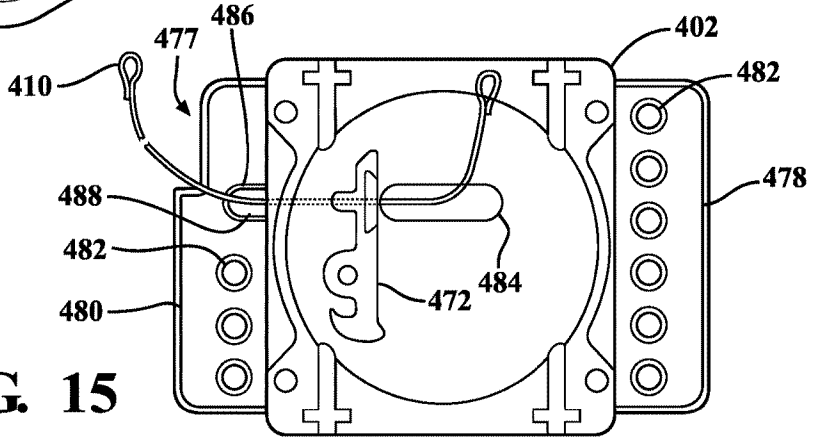
FIG. 15 is a top view of the tensioning device of FIG. 13, where internal components of the tensioning device are hidden to show a construction of a housing of the tensioning device.

FIG. 15 provides a top view of the housing 402*a* showing a pair of mounting flanges 478, 480 disposed on opposite sides of the housing 402*a*. The mounting flanges 478, 480 may rest upon an inner surface of the recess 124 of the sole structure 200*g* to mount the tensioning device 400*a* within the sole structure 200*g*. Alternatively, the flanges 478, 480 may attach to a strobel of the upper 100*g*. The strobel can be any support structure forming an underfoot portion of the footwear 10 that is at least disposed between the sole structure 200*g* and the interior void 118. In some examples, bonding agents, such as adhesives and/or epoxies, may be applied to the contact surfaces of the mounting flanges 478, 480 and/or the inner surface of the recess 124 of the sole structure 200*g* for attaching the housing 402*a* within the recess 124. Additionally or alternatively, the mounting flanges 478, 480 may define one or more mounting holes 482 formed therethrough and configured to receive a fastener (not shown) for mounting the housing 402*a* to the sole structure 200*g*.

FIG. 15 shows the housing 402*a* with the pawls 458, 460, adjustment elements 312, 314, and other components of the tensioning device 400*a* removed to expose an elongate channel 484 formed through the housing 402*a*. As discussed in greater detail below, the elongate channel 484 aligns with an attachment point of the first pawl 458 and permits the release cord 404 to pass underneath the housing 402*a* and up through a feed slot 486 defined by the mounting flange 480. The mounting flange 480 also defines a cut-out region 477 proximate to the feed slot 486 to provide more clearance for the release cord 404 (and/or a conduit enclosing the release cord 404) to extend from the housing 402*a*. The mounting flanges 478, 480 may define a lip around the perimeter of the housing 402*a* so that the housing 402*a* is spaced apart from the mounting surface of the recess 124 or the strobel, allowing the release cord 404 to be routed between the housing 402*a* and the mounting surface of the recess 124 or strobel. Thus, the release cord 404 may freely extend underneath the housing 402*a* between the elongate channel 484 and the feed slot 486. In some examples, the feed slot 486 has a curved edge to prevent the release cord 404 from catching or being restricted by the housing 402*a*.

Figure 14:
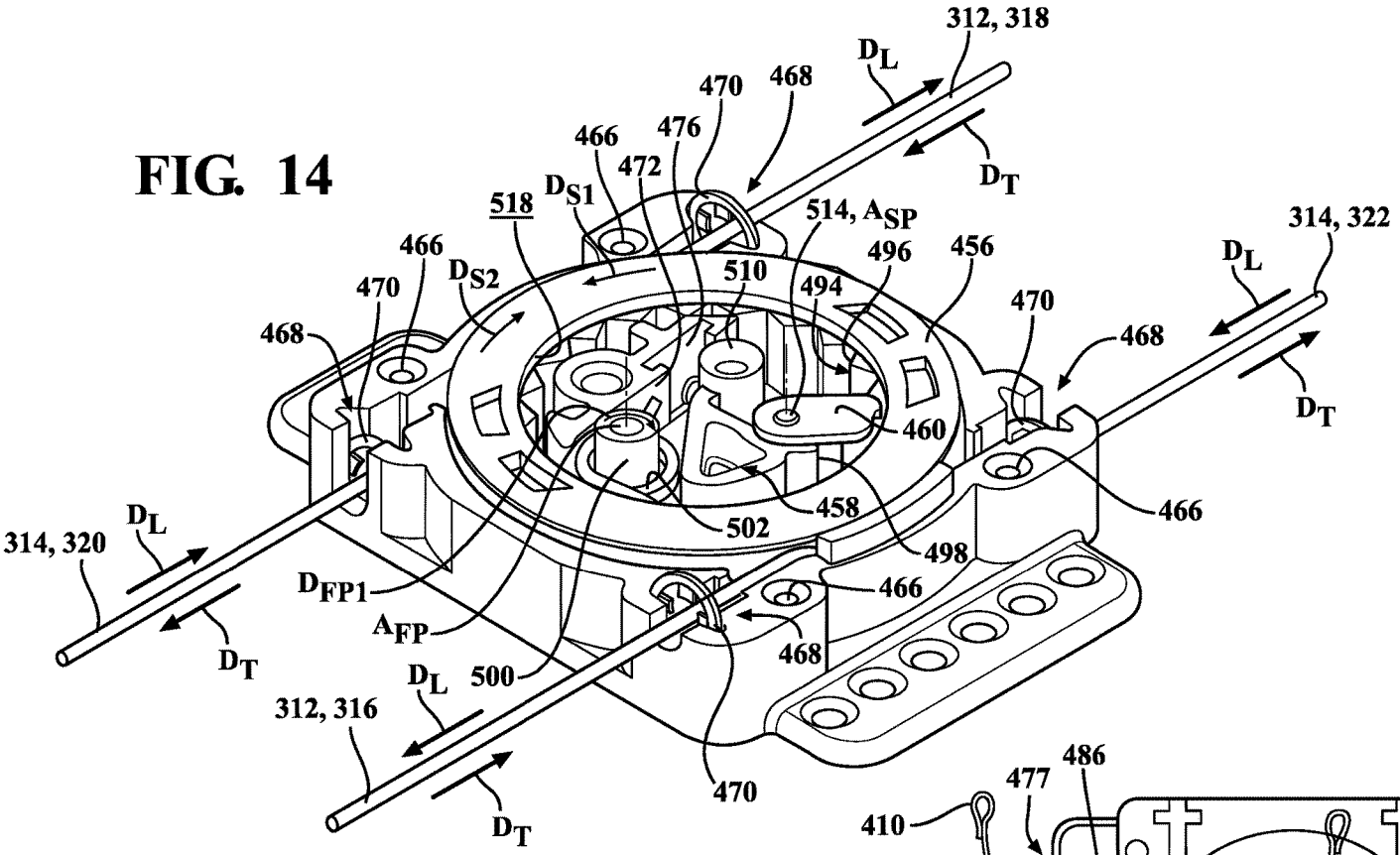
FIG. 14 is a perspective view of the tensioning device of FIG. 13.

Referring now to FIG. 14, the spool 456 is supported within the cavity 454 of the housing 402*a* and may rotate relative to the housing 402*a*. In some examples, the spool 456 rotates relative to the housing 402*a* in a first direction $D_{S1}$ when the adjustment elements 312, 314 move in the tightening direction $D_T$ and in an opposite second direction $D_{S2}$ when the adjustment elements 312, 314 move in the loosening direction $D_L$. The spool 456 includes a first channel or annular groove 488 configured to collect portions of the tensioning element 312 and a second channel or annular groove 490 configured to collect portions of the control element 314. The spool 456 may include one or more anchor slots 492 formed through a divider wall separating the channels 488, 490 for fixing a rotational position of each of the adjustment elements 312, 314 relative to the spool 456.

The tensioning device 400*a* also includes a ratchet mechanism 494 associated with the spool 456 and having a plurality of teeth 496 positioned circumferentially around an axis of the ratchet mechanism 494 and protruding radially inward therefrom. In some implementations, the ratchet mechanism 494 is integrally formed upon an inner circumferential wall of the spool 456 such that the plurality of teeth 496 protrude radially inward from the channels 488, 490. In other examples, the ratchet mechanism 494 is supported for common rotation with the spool 456.

The first pawl 458 is disposed within the cavity 454 of the housing 402*a* and is configured to cooperate with the ratchet mechanism 494 to selectively prevent and allow rotation of the spool 456 and, consequently, movement of the adjustment elements 312, 314. In some examples, the first pawl 458 includes one or more teeth 498 configured to selectively and meshingly engage with the plurality of teeth 496 of the ratchet mechanism 494. In some implementations, the first pawl 458 includes a first pawl axle 500 configured to support the first pawl 458 within the housing 402*a* to permit the first pawl 458 to rotate relative to the housing 402*a* about a first pawl axis of rotation $A_{FP}$.

A first pawl spring 502 may operably connect to the first pawl axle 500 and the retaining wall 472 disposed within the cavity 454 of the housing 402*a* to bias the first pawl 458 in a first direction $D_{FP1}$ about the pawl axis of rotation $A_{FP}$. The first pawl axis of rotation $A_{FP}$ may be substantially parallel to an axis of rotation of the spool 456 when the spool 456 is received by the cavity 454. Accordingly, the first pawl spring 502 may interact with the retaining wall 472 and the first pawl 516 to exert a biasing force that causes the first pawl 458 to pivot about the pawl axis of rotation $A_{FP}$ in the first direction $D_{FP1}$ and into engagement with the plurality of teeth 496 of the ratchet mechanism 494, thereby causing the tensioning device 400*a* to operate in the locked state to restrict movement by the adjustment elements 312, 314 in the loosening directions $D_L$.

Figure 16:
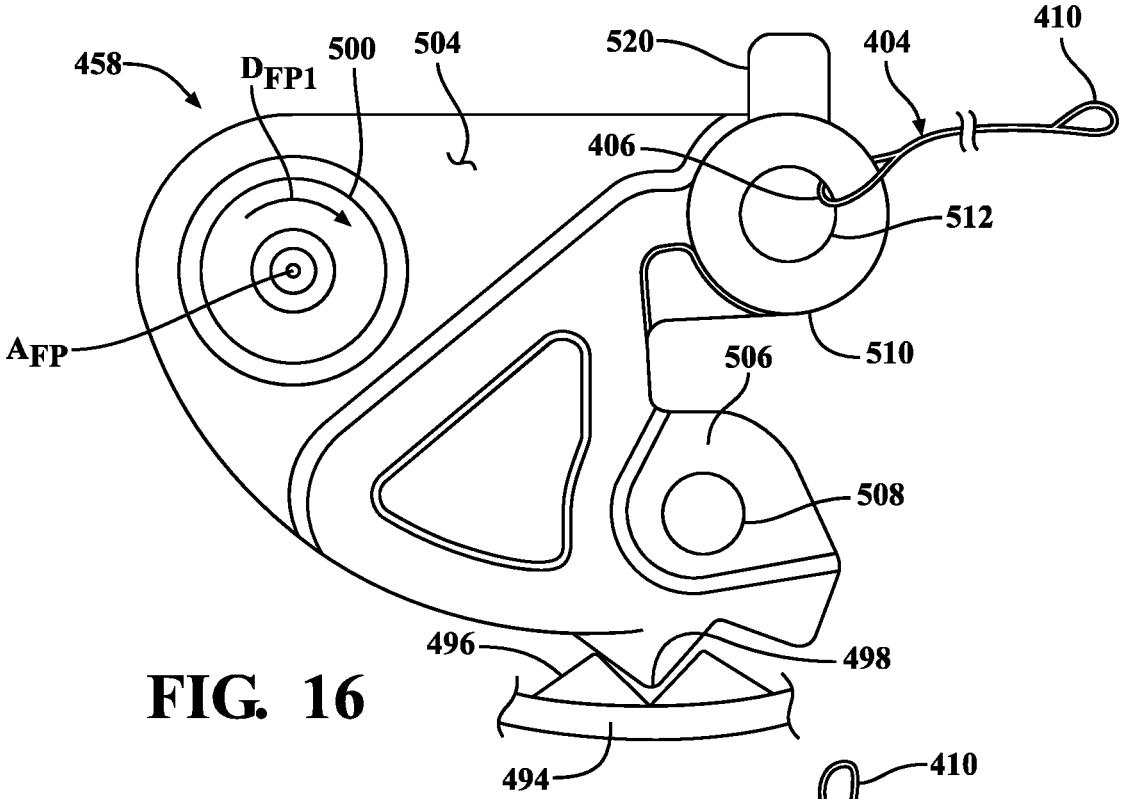
FIG. 16 is an enlarged fragmentary view of the tensioning device of FIG. 13, showing the tensioning device in a locked position.
Figure 17:
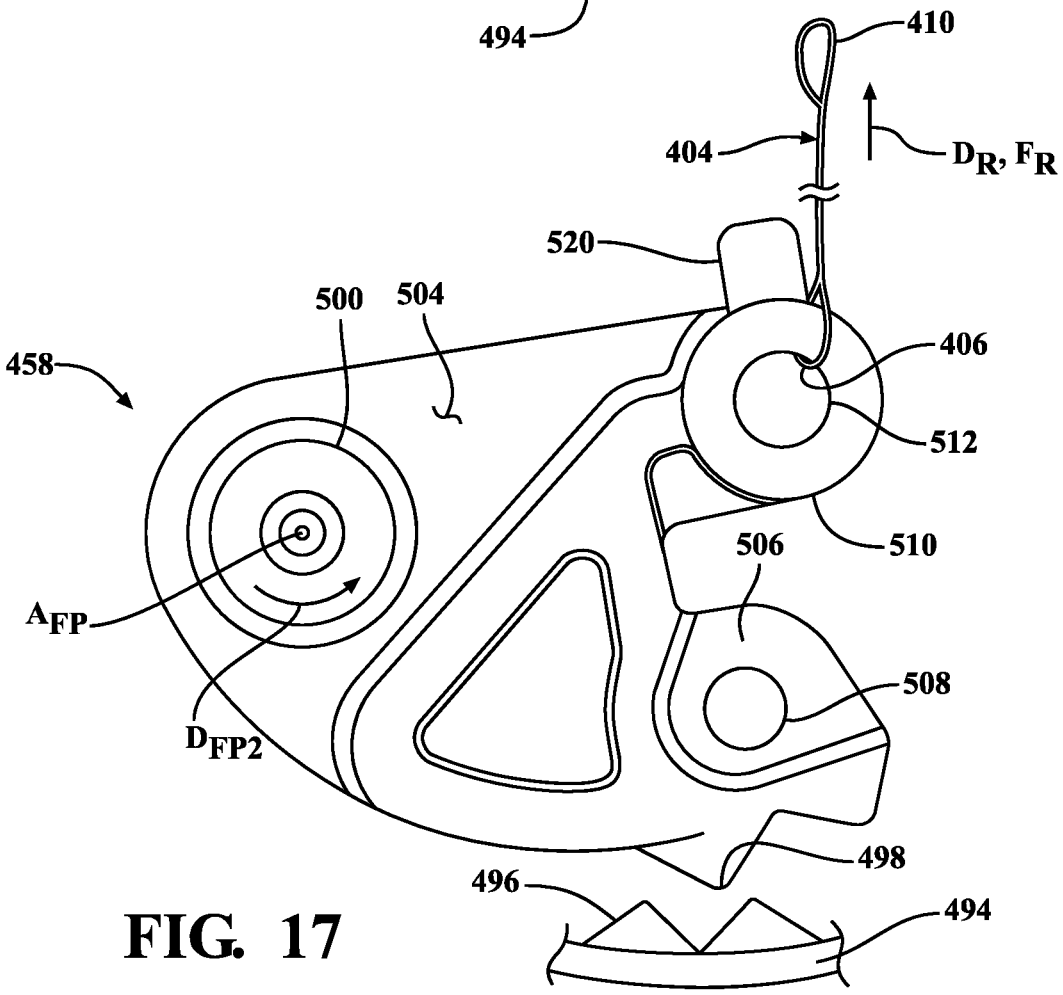
FIG. 17 is an enlarged fragmentary view of the tensioning device of FIG. 13, showing the tensioning device in an unlocked position.

FIGS. 16 and 17 each show a top view of the first pawl 458 of the tensioning device 400*a*. The first pawl 458 defines a first receiving surface 504 configured to support the first pawl spring 502. The first pawl axle 500 protrudes from the first receiving surface 504 in a direction substantially perpendicular to the first receiving surface 504. The first pawl axle 500 may be integrally formed with the first pawl 458. The first pawl 458 also defines a second receiving surface 506 configured to support a second pawl spring 516. An aperture 508 is formed through the second receiving surface 506 and is configured to receive a second pawl axle 514. An anchor post 510 may protrude away from the receiving surfaces 504, 506 in a direction substantially parallel to the first pawl axle 500. The anchor post 510 may define an aperture 512 to provide an attachment location for attaching the first end 406 of the release cord 404 to the anchor post 510. The anchor post 510 may be integrally formed with the first pawl 458.

With reference to FIG. 14, the second pawl axle 514 rotatably attaches the second pawl 460 to the first pawl 458 to permit the second pawl 460 to rotate relative to both the first pawl 458 and the housing 402*a* about a second pawl axis of rotation $A_{SP}$. The second pawl axis of rotation $A_{SP}$ may extend substantially parallel to the first pawl axis of rotation $A_{FP}$ and the axis of rotation of the spool 456. In some examples, the second pawl 460 is associated with the second pawl spring 516, which is configured to bias the second pawl 460 into engagement with a control surface 518 associated with an inner periphery of the spool 456 when the first pawl 458 is disengaged from the teeth 496 of the ratchet mechanism 494 to permit the spool 456 to rotate in the second direction $D_{S2}$.

FIG. 14 provides a perspective view of the tensioning device 400*a* while in the locked state with the first pawl teeth 498 of the first pawl 458 engaging the teeth 496 of the ratchet mechanism 494 to selectively restrict the spool 456 from rotating in the second direction $D_{S2}$ and thereby restrict the adjustment elements 312, 314 from moving in their respective loosening directions $D_L$. In some examples, the plurality of the teeth 496 are sloped to permit the spool 456 to rotate in the first direction $D_{S1}$ when the teeth 498 of the first pawl 458 are engaged with the teeth 496 of the ratchet mechanism 494, thereby permitting the tensioning element 312 to move in the tightening direction $D_T$ and the control element 314 to move in the tightening direction $D_T$ responsive to the tightening force $F_T$ being applied to the tightening grip 340.

When the spool 456 rotates in the first direction $D_{S1}$, the control element 314 is unreeled from the second channel 490 of the spool 456 while the first channel 488 of the spool 456 simultaneously retracts the tensioning element 312 as the spool 456 rotates in the first direction $D_{S1}$. Accordingly, movement by the adjustment elements 312, 314 in their respective tightening directions $D_T$ causes an effective length of the control element 314 to increase, while simultaneously causing an effective length of the tensioning element 312 to decrease, thereby moving the upper 100*g* into a tightened state for closing the interior void 118 around a foot of a user. Here, the control element 314 incrementally moves in the tightening direction $D_T$ during each successive engagement between the first pawl 458 (e.g., first pawl teeth 498) and the teeth 496 of the ratchet mechanism 494 to thereby incrementally increase the tension applied to medial and lateral tensioning strands 316, 318 of the tensioning element 312 for tightening the fit of the interior void 118 around the foot as the upper 100*g* moves into the tightened state. More particularly, because each of the lateral tensioning strand 318 and the medial tensioning strand 316 of the tensioning element 312 is connected to and disposed within the first channel 488 of the spool 456, each of the tensioning strands 316, 318 will be wound and unwound by the spool 456 at the same rate, providing substantially uniform tightness of the upper 100*g* around the foot.

In some examples, the release cord 404 operably connects to the anchor post 510 of the first pawl 458 to selectively disengage the first pawl 458 from the teeth 496 of the ratchet mechanism 494 when a predetermined release force $F_R$ is applied to the release cord 404. When the second pawl 460 is engaged with the control surface 518, the second pawl 460 is operative to control the rotational speed of the spool 456 in the second direction $D_{S2}$ such that the adjustment elements 312, 314 do not become tangled when collected (e.g., wound) or released (e.g., unwound) from respective ones of the first channel 488 and the second channel 490 of the spool 456 during rotation in the second direction $D_{S2}$. In some configurations, the second pawl 460 includes two cam surfaces that remain engaged with respective ones of two control surfaces 518 when the first pawl 458 remains disengaged from the teeth 496 (i.e., when the tensioning device 400*a* is operable in the unlocked state). Each control surface 518 may be axially disposed on an opposite side of the ratchet mechanism 494 such that the teeth 496 are disposed between the control surfaces 518 and protrude radially inward therefrom.

Referring to FIG. 16, the first pawl 458 is biased into engagement with the plurality of teeth 496 of the ratchet mechanism 494 when the tensioning device 400*a* is in the locked state. Here, the first pawl 458 pivots and rotates about the first pawl axis of rotation $A_{FP}$ in the first direction $D_{FP1}$ such that the teeth 498 of the first pawl 458 engage with the teeth 496 of the ratchet mechanism 494. In some examples, the first pawl 458 includes a tactile protrusion 520 configured to engage with the tactile domes 476 to provide the "click" indicating the incremental change of position in the spool 456 during each successive engagement between the first pawl 458 and the teeth 496.

Referring to FIG. 17, a first end 406 of the release cord 404 is attached to the anchor post 510 of the first pawl 458 to allow the release cord 404 to selectively disengage the first pawl 458 from the teeth 496 of the ratchet mechanism 494 when the predetermined release force $F_R$ is applied to the release cord 404. For example, a user may grasp the release grip 410 of the release cord 404 and apply the predetermined force $F_R$ to disengage the first pawl 458 from the teeth 496 of the ratchet mechanism 494. Here, the predetermined force $F_R$ overcomes the biasing force of the first pawl spring 502 to allow the first pawl 458 to rotate about the first pawl axis of rotation $A_{FP}$ in a second direction $D_{FP2}$. Additionally, the tactile protrusion 520 may engage with the tactile dome 476 to provide the "click" when the predetermined force $F_R$ moves to the first pawl 458 out of engagement with the teeth 496 to transition the tensioning device 400*a* to the unlocked state.

FIG. 17 shows the tensioning device 400*a* in the unlocked state responsive to the release cord 404 selectively disengaging the first pawl 458 from the teeth 496 of the ratchet mechanism 494 when the predetermined force $F_R$ is applied to the release cord 404. While the tensioning device 400*a* is in the unlocked state with the first pawl 458 disengaged from the teeth 496 of the ratchet mechanism 494, the spool 456 is permitted to rotate in the second direction $D_{S2}$ to allow the tensioning element 312 to move in the loosening direction $D_L$ when the loosening force $F_L$ is applied to the tensioning element 312. In some examples, the first channel 488 of the spool 456 collects the tensioning element 312 while the second channel 490 of the spool 456 simultaneously releases the control element 314 as the spool 456 rotates in the second direction $D_{S2}$. Accordingly, movement of the control element 314 in the loosening direction $D_L$ allows an effective length of the tensioning element 312 to increase to allow the tensioning strands 316, 318 to relax and thereby facilitate a transition of the upper 100*g* from the tightened state to the loosened state such that a foot can be removed from the interior void 118.

Referring back to FIG. 13, the lid 462 and the housing 402*a* of the tensioning device 400*a* may each include a hub 522 configured to support the first pawl axle 500 of the first pawl 458. The lid 462 may also each include an elongate channel 524 that cooperates with the elongate channel 484 of the housing 402*a* to allow the anchor post 510 of the first pawl 458 to freely rotate relative to the housing 402*a* and the lid 462 when the first pawl 458 pivots about the first pawl axis of rotation $A_{FP}$ in either the first direction $D_{FP1}$ or the second direction $D_{FP2}$.

In use, the article of footwear 10 can be selectively moved between a tightened state and a relaxed state using the tensioning system 300. With the footwear 10 initially provided in a relaxed state, an effective length of the tensioning element 312 will be maximized, such that the first cable is in a relaxed state about the upper 100*g*, while an effective length of the control element 314 is minimized as the control element 314 is wound about the spool 456 of the tensioning device 400*a*. Accordingly, a foot of a user can be inserted into the interior void 118 of the footwear 10 with the materials of the upper 100*g* allowing the upper 100*g* to stretch to accommodate the foot therein.

With the foot of the user inserted within the interior void 118 of the upper 100*g*, the tensioning system 300 can be moved to a tightened state by the user to secure the footwear 10 to the foot. As discussed above, the tensioning system 300 is moved to the tightened state by applying a tightening force $F_T$ to the tightening grip 340, thereby causing the control element 314 to move in the tightening direction $D_T$. As the control element 314 moves in the tightening direction $D_T$, the spool 456 rotates in the first direction $D_{S1}$ and the control element 314 is unwound from the second channel 490. Simultaneously, the tensioning element 312 is wound up within the first channel 488, thereby causing the tensioning element 312 to be retracted within the tensioning device 400*a*. Accordingly, an effective length of the tensioning element 312 is minimized around the upper 100*g* to move the upper 100*g* to a tightened state around the foot.

Prior to, during, or after movement of the tensioning system 300 to the tightened state, the biasing force of the first pawl spring 502 may move the first pawl 458 to the locked position when the release force $F_R$ applied to the release cord 404 is overcome by the first pawl spring 502. When the tensioning device 400*a* is in the locked state, the teeth 496 of the spool 456 are engaged by the teeth 498 of the first pawl 458 to prevent the spool 456 from rotating in the second direction $D_{S2}$ (i.e., the loosening direction $D_L$). Accordingly, the tensioning device 400*a* maintains the tensioning system 300 in the tightened state as long as the tensioning device 400*a* remains in the locked position.

When a user desires to remove the article of footwear 10 from the foot, the tensioning system 300 may be moved to the loosened state to allow the upper 100*g* to be relaxed around the foot. Initially, the tensioning device 400*a* must be moved to the unlocked state by applying a sufficient release force $F_R$ to overcome the biasing force of the first pawl spring 502. When the release force $F_R$ overcomes the biasing force, the teeth 498 of the first pawl 458 will disengage from the teeth 496 of the spool 456, thereby allowing the spool 456 to rotate in the second direction $D_{S2}$.

A loosening force $F_L$ may be applied to the tensioning element 312 by the user to move the first cable in the loosening direction $D_L$, thereby maximizing the effective length of the tensioning element 312 to allow the upper 100*g* to be relaxed. In the illustrated example, the loosening force $F_L$ may be applied indirectly to the tensioning element 312 by pulling the anterior end 12 of the upper 100*g* in a downward direction, whereby the interior void 118 is forced open to remove the foot. Alternatively, the tensioning element 312 may be provided with one or more loosening grips (not shown) to allow the user to apply the loosening force $F_T$ directly to the tensioning element 312.

As the tensioning element 312 moves in the loosening direction $D_L$, the spool 456 rotates in the second direction $D_{S2}$ and the tensioning element 312 is unwound from the first channel 488. As the tensioning element 312 is unwound, the effective length of the tensioning element 312 increases and the tensioning strands 316, 318 are relaxed, allowing the adjustment straps 114*g* to relax about the upper 100*g*. Simultaneously, the control element 314 is wound up within the second channel 490, thereby causing the control element 314 to be retracted within the tensioning device 400*a*. Accordingly, an effective length of the control element 314 is minimized.

Figure 18A:
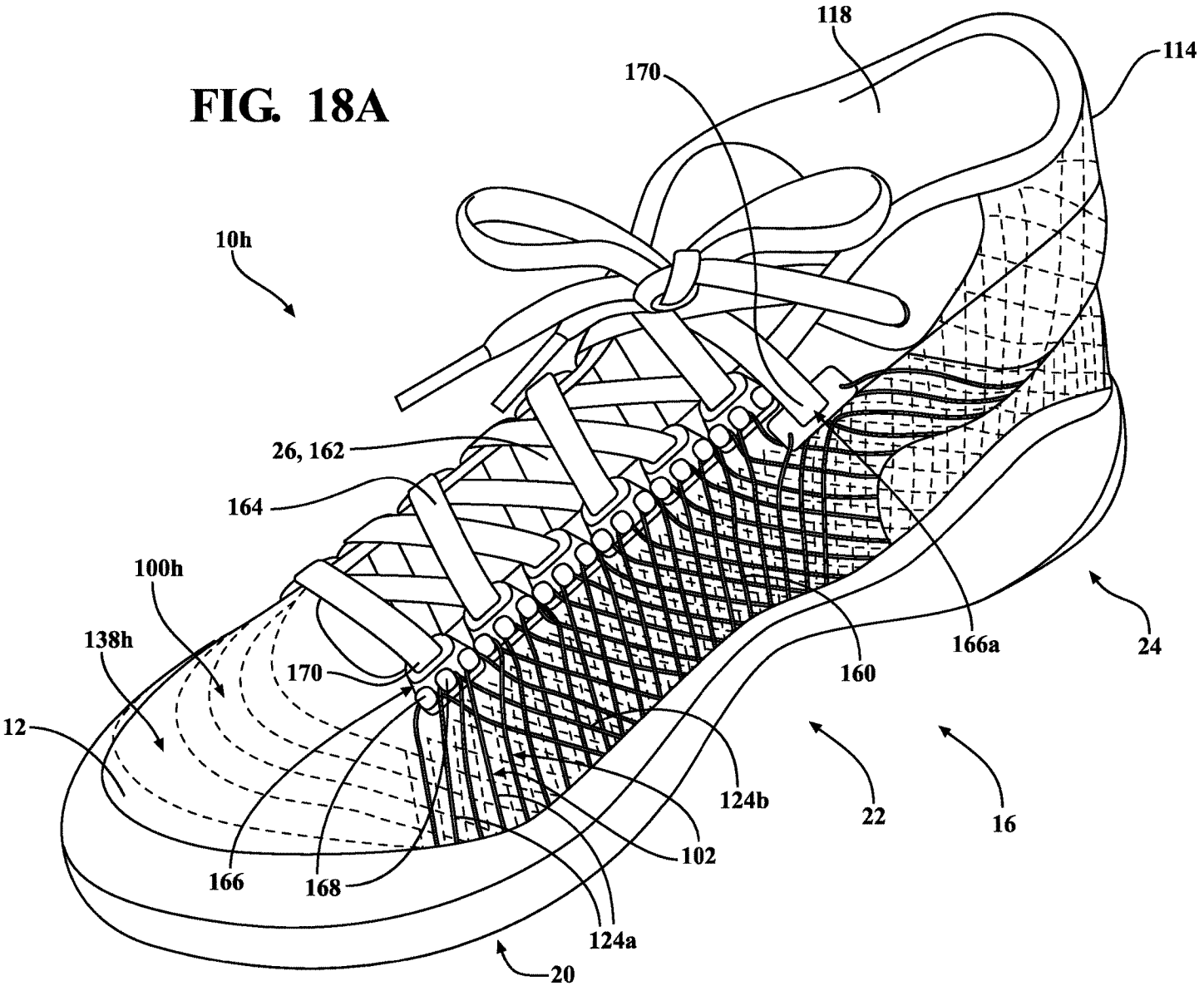
FIG. 18A is a top perspective view of an article of footwear according to the principles of the present disclosure.
Figure 18B:
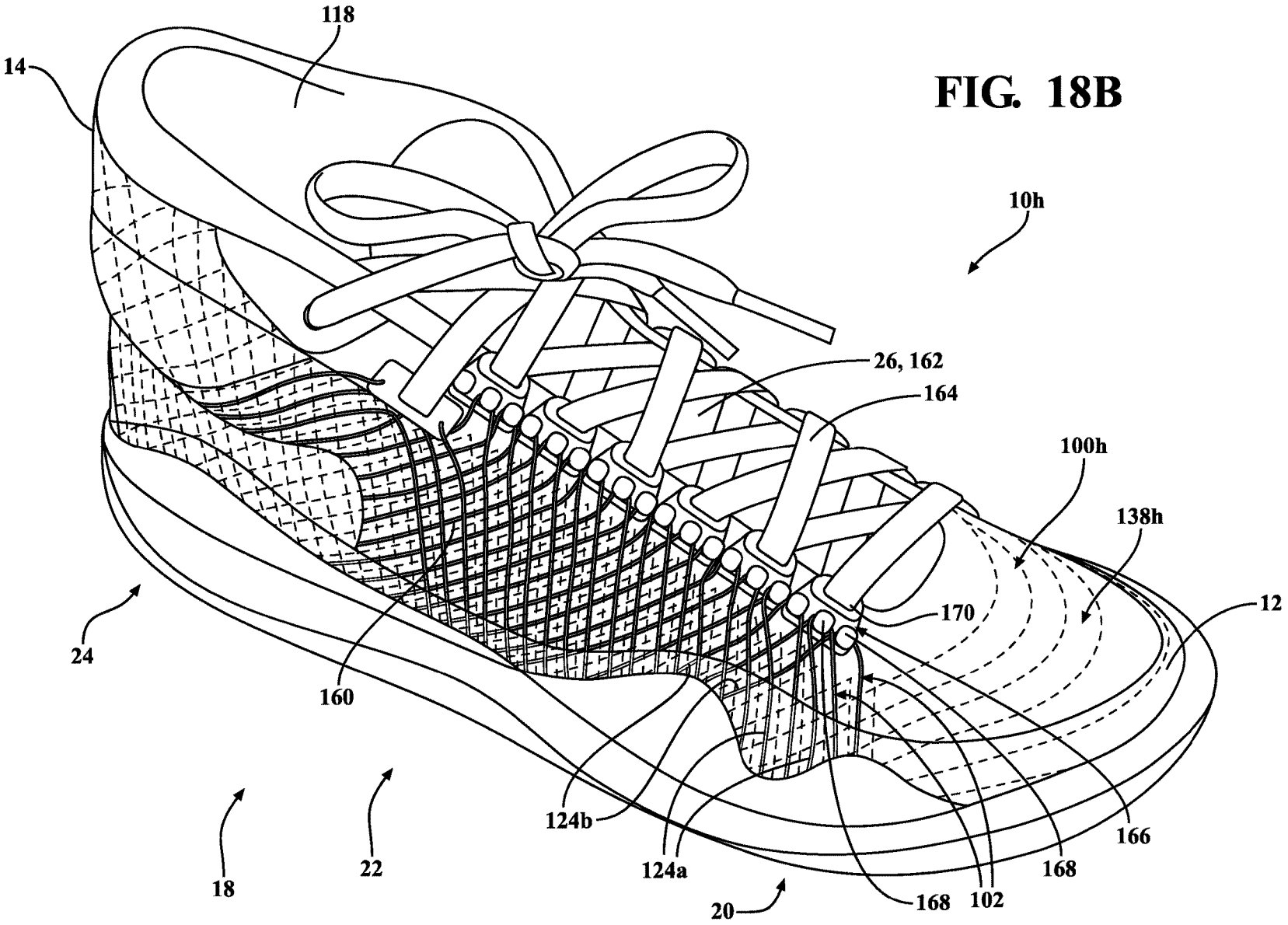
FIG. 18B is a medial side perspective view of the article of footwear of FIG. 18B.

With particular reference to FIGS. 18A and 18B, an article of footwear 10*h* is provided and includes an upper 100*h* and the sole structure 200 attached to the upper 100*h*. In view of the substantial similarity in structure and function of the components associated with the article of footwear 10 with respect to the article of footwear 10*h*, like reference numerals are used hereinafter and in the drawings to identify like components, while like reference numerals containing letter extensions are used to identify those components that have been modified.

In the example of FIGS. 18A and 18B, the upper 100*h* includes an enclosure 138*h* having a plurality of components that cooperate to define the interior void 118. For example, the upper 100*h* includes a pair of quarter panels 160 in the mid-foot region 22 on opposite sides of the interior void 118. A tongue or throat 162 extends across the top of the upper 100*g* and defines the instep region 26 extending between the quarter panels 208 from the ankle opening to the forefoot region 20. As shown in FIGS. 18A and 18B, the upper 100*h* includes a lace 164 routed between the quarter panels 160 and along the length of the throat 162. The lace 164 can be tightened and tied to adjust a fit of the upper 100*h* around the foot.

The upper 100*g* includes a first plurality of the strands 102 arranged in series along the medial side 16 and a second plurality of the strands 102 arranged in series along the lateral side 18. Each of the strands extends from a first end 104 attached at the bite line 28 and a second end 106 attached at the bite line 28 closer to the posterior end 14 than the first end 104. Thus, each strand 102 forms a first segment 124*a* and a second segment 124*b* folded over on the first segment 124*a* to form a loop 126 disposed adjacent to the throat 162. Each series of strands 102 forms a corresponding series of the loops 126 arranged along the length of the throat 162. Thus, a first series of the loops 126 is arranged along the medial side 16 of the throat 162 and a second series of the loops 126 is arranged along the lateral side 18 of the throat 162.

With continued reference to FIGS. 9A and 9B, the upper 100*h* may include one or more buckles 166 configured to connect the lace 164 to the strands 102. In the illustrated example, the upper 100*h* includes a plurality of the buckles 166, 166*a* arranged along each side of the throat 162. Each buckle 166, 166*a* includes one or more apertures 168 disposed at a first end of the buckle 166. Corresponding ones of the strands 102 are routed through the apertures 168 to secure the buckle 166 to the upper 100*h*. The illustrated examples of the buckles 166, 166*a* each include three of the apertures 168. The opposite end of each buckle 166 includes an eyelet 170 for receiving the lace 164. Thus, each buckle 166, 166*a* is configured to secure a portion of the lace 164 to a corresponding group of the strands 102 arranged along a side 16, 18 of the enclosure 138*h*.

While the examples of the articles of footwear 10-10*h* described above are provided for illustrative purposes, features of the articles of footwear 10-10*h* can be modified without departing from the scope of this disclosure. For example, the fixed straps 112-112*f* can be provided on the medial side 16 or the lateral side 18, while the corresponding adjustment straps 114-114*g* can be provided on the other of the medial side 16 or the lateral side 18. Additionally, the number of strands 102 in each of the straps 112-112*f*, 114-114*g* can be altered. In some examples, the straps 112-112*f*, 114-114*g* may include more or less strands 102. In some examples, the straps 112-112*f*, 114-114*g* may include at least five (5) strands 102 routed in parallel. In other examples, the straps 112-112*f*, 114-114*g* include at least ten (10) strands 102 routed in parallel.

The following Clauses provide examples of an upper for an article of footwear and an article of footwear described above.

Clause 1. An upper for an article of footwear, the upper comprising a first strap having a plurality of parallel first strands each extending from a first end attached to one of a medial side and a lateral side of the upper and each including a loop disposed adjacent to an instep region of the upper and a second strap having a plurality of parallel second strands each extending from a second end attached to the other one of the medial side and the lateral side of the upper to a third end selectively attachable to the other one of the medial side and the lateral side of the upper, each of the second strands passing through the loop of a respective one of the first strands.

Clause 2. The upper of Clause 1, wherein the third end of each of the second strands is attached to a closure selectively attachable to the upper.

Clause 3. The upper of any of the preceding Clauses, wherein the first end of each of the first strands is attached to a bite line of the upper at respective first locations.

Clause 4. The upper of Clause 3, wherein the first locations are located in a mid-foot region of the upper.

Clause 5. The upper of any of the preceding Clauses, wherein each of the first strands includes a first segment extending from a bite line of the upper to the loop, and a second segment extending from the bite line of the upper to the loop.

Clause 6. The upper of any of the preceding Clauses, wherein the plurality of first strands includes at least five (5) strands.

Clause 7. The upper of any of the preceding Clauses, further comprising a plurality of third strands each extending over a toe portion of the upper.

Clause 8. The upper of any of the preceding Clauses, further comprising a closure disposed adjacent to a bite line of the upper, the third ends of the second strands selectively attachable to the closure.

Clause 9. The upper of Clause 8, wherein the closure is disposed on the lateral side of the upper.

Clause 10. The upper of any of the preceding Clauses, wherein two or more of the first strands are attached to each other.

Clause 11. An upper for an article of footwear, the upper comprising a fixed closure disposed on one of a medial side and a lateral side of the upper, a plurality of parallel first strands each extending from a first end attached to the other one of the medial side and the lateral side of the upper to a second end attached the other one of the medial side and the lateral side and including a first intermediate portion formed between the first end and the second end, and a plurality of parallel second strands each extending from a third end attached to the one of the medial side and the lateral side of the upper to a fourth end selectively attachable to the fixed closure, the second strands looped around the first intermediate portion of respective ones of the first strands.

Clause 12. The upper of Clause 11, further comprising an adjustable closure attached to the fourth ends of the plurality of parallel second strands, the adjustable closure selectively attachable to the fixed closure.

Clause 13. The upper of any of the preceding Clauses, wherein the first end of each of the first strands is attached to a bite line of the upper at respective first locations, and the second end of each of the first strands is attached to the bite line of the upper at respective second locations.

Clause 14. The upper of any of the preceding Clauses, wherein the intermediate portion of each of the first strands includes a loop.

Clause 15. The upper of Clause 14, wherein the loop of each of the first strands is disposed along an instep region of the upper.

Clause 16. The upper of any of the preceding Clauses, wherein the plurality of parallel first strands includes at least five (5) strands.

Clause 17. The upper of any of the preceding Clauses, further comprising a toe cap including a plurality of third strands each extending from a fifth end attached to the medial side in a forefoot region of the upper to a sixth end attached to the lateral side in the forefoot region.

Clause 18. The upper of any of the preceding Clauses, wherein the fixed closure is disposed adjacent to a bite line of the upper.

Clause 19. The upper of any of the preceding Clauses, wherein the fixed closure is disposed on the lateral side of the upper.

Clause 20. The upper of any of the preceding Clauses, wherein two or more of the first strands are attached to each other.

Clause 21. An article of footwear including the upper of any one of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An upper for an article of footwear, the upper comprising:

a first strap having a plurality of parallel first strands each including a first segment extending from a first end attached to one of a medial side and a lateral side of the upper to an instep region of the upper and a second segment extending at an oblique angle relative to the first segment and from the instep region of the upper to a second end attached to the one of the medial side and the lateral side, each of the plurality of first strands including a loop disposed adjacent to the instep region of the upper, wherein the distal most second segments overlapping a plurality of adjacent first segments;

a second strap having a plurality of parallel second strands each extending from a third end attached to the other one of the medial side and the lateral side of the upper to a fourth end selectively attachable to the other one of the medial side and the lateral side of the upper, each of the second strands passing through the loop of a respective one of the first strands;

a plurality of third strands each extending over a toe portion of the upper from the lateral side to the medial side, the plurality of third strands including a first group of the third strands each extending parallel to one another and a second group of the third strands each extending parallel to one another, the first group of the third strands extending at an oblique angle relative to the second group of the third strands; and an elastomeric web extending below the plurality of third strands and from the lateral side to the medial side, portions of the plurality of third strands embedded in the elastomeric web.

2. The upper of claim 1, wherein the fourth end of each of the second strands is attached to a closure selectively attachable to the upper.

3. The upper of claim 1, wherein the first end of each of the first strands is attached to a bite line of the upper at respective first locations.

4. The upper of claim 3, wherein the first locations are located in a mid-foot region of the upper.

5. The upper of claim 1, wherein the first segment and the second segment of each of the first strands extends from a bite line of the upper to the loop.

6. The upper of claim 1, wherein the plurality of first strands includes at least five (5) strands.

7. The upper of claim 1, further comprising a closure disposed adjacent to a bite line of the upper, the fourth ends of the second strands selectively attachable to the closure.

8. The upper of claim 7, wherein the closure is disposed on the lateral side of the upper.

9. The upper of claim 1, wherein two or more of the first strands are attached to each other.

10. An upper for an article of footwear, the upper comprising:

a fixed closure disposed on one of a medial side and a lateral side of the upper;

a plurality of parallel first strands each including a first segment extending from a first end attached to the other one of the medial side and the lateral side of the upper to an instep region of the upper and a second segment extending at an oblique angle relative to the first segment and from the instep region of the upper to a second end attached the other one of the medial side and the lateral side and including a first intermediate portion formed between the first end and the second end, wherein the distal most second segments overlapping a plurality of adjacent first segments;

a plurality of parallel second strands each extending from a third end attached to the one of the medial side and the lateral side of the upper to a fourth end selectively attachable to the fixed closure, the second strands looped around the first intermediate portion of respective ones of the first strands;

a plurality of third strands each extending over a toe portion of the upper from the lateral side to the medial side, the plurality of third strands including a first group of the third strands each extending parallel to one another and a second group of the third strands each extending parallel to one another, the first group of the third strands extending at an oblique angle relative to the second group of the third strands; and an elastomeric web extending below the plurality of third strands and from the lateral side to the medial side, portions of the plurality of third strands embedded in the elastomeric web.

11. The upper of claim 10, further comprising an adjustable closure attached to the fourth ends of the plurality of parallel second strands, the adjustable closure selectively attachable to the fixed closure.

12. The upper of claim 10, wherein the first end of each of the first strands is attached to a bite line of the upper at respective first locations, and the second end of each of the first strands is attached to the bite line of the upper at respective second locations.

13. The upper of claim 10, wherein the intermediate portion of each of the first strands includes a loop.

14. The upper of claim 13, wherein the loop of each of the first strands is disposed along the instep region of the upper.

15. The upper of claim 10, wherein the plurality of parallel first strands includes at least five (5) strands.

16. The upper of claim 10, wherein the plurality of third strands each extend from a fifth end attached to the medial side in a forefoot region of the upper to a sixth end attached to the lateral side in the forefoot region.

17. The upper of claim 10, wherein the fixed closure is disposed adjacent to a bite line of the upper.

18. The upper of claim 10, wherein the fixed closure is disposed on the lateral side of the upper.

19. The upper of claim 10, wherein two or more of the first strands are attached to each other.

* * * * *